US011432649B2

(12) United States Patent
Beech et al.

(10) Patent No.: US 11,432,649 B2
(45) Date of Patent: Sep. 6, 2022

(54) ADJUSTABLE DESK CHAIR

(71) Applicant: BEECH ENTERPRISES, LLC, Sandy, UT (US)

(72) Inventors: James Beech, Sandy, UT (US); David Richins, Sandy, UT (US)

(73) Assignee: BEECH ENTERPRISES, LLC, Sandy, UT (US)

( * ) Notice: Subject to any disclaimer, the term of this patent is extended or adjusted under 35 U.S.C. 154(b) by 15 days.

(21) Appl. No.: 17/031,743

(22) Filed: Sep. 24, 2020

(65) Prior Publication Data

US 2021/0085083 A1 Mar. 25, 2021

Related U.S. Application Data

(60) Provisional application No. 62/905,173, filed on Sep. 24, 2019.

(51) Int. Cl.

| | |
|---|---|
| ***A47C 7/46*** | (2006.01) |
| ***A47C 3/025*** | (2006.01) |
| ***A47C 3/026*** | (2006.01) |
| ***A47C 7/00*** | (2006.01) |

(52) U.S. Cl.

CPC ..... *A47C 3/0251* (2018.08); *A47C 3/026* (2013.01); *A47C 7/004* (2013.01); *A47C 7/462* (2013.01)

(58) Field of Classification Search

CPC ..... A47C 3/0251; A47C 3/026; A47C 7/004; A47C 7/462

USPC ..... 297/284.4, 284.7

See application file for complete search history.

(56) References Cited

U.S. PATENT DOCUMENTS

| | | | | |
|---|---|---|---|---|
| 5,401,077 | A * | 3/1995 | Hosoe | A47C 1/03 297/312 |
| 5,556,163 | A | 9/1996 | Rogers et al. | |
| 6,530,622 | B1 * | 3/2003 | Ekern | B60N 2/2222 297/284.4 X |
| 6,938,956 | B1 * | 9/2005 | Piretti | A47C 7/38 297/284.7 X |
| 7,059,678 | B1 * | 6/2006 | Taylor | A47C 7/405 297/284.4 |
| 7,163,263 | B1 * | 1/2007 | Kurrasch | A47C 1/0242 297/330 X |

(Continued)

FOREIGN PATENT DOCUMENTS

EP 2 656 750 A1 10/2013

OTHER PUBLICATIONS

PCT International Search Report and Written Opinion issued in corresponding application No. PCT/US2020/052589, dated Dec. 9, 2020.

*Primary Examiner* — Rodney B White

(74) *Attorney, Agent, or Firm* — Morriss O'Bryant Compagni Cannon, PLLC

(57) ABSTRACT

An adjustable chair comprising a seat part, a seat back disposed along one side of the seat part, the seat back being configured for supporting at least a person's back or shoulders, a chair base configured for being placed on a floor, at least one adjustable chair feature including a motor capable of being selectively controlled and driven so as to adjust at least one of: the rotation or tilt of the seat part, a vertical distance between the seat back and the one side of the seat part, an angle position between the seat back and the seat part, and a distance between the chair base and the seat part.

11 Claims, 31 Drawing Sheets

(56) References Cited

U.S. PATENT DOCUMENTS 7,396,082 B2 * 7/2008 Sanchez ..... A47C 7/405 297/284.4
7,585,028 B2 * 9/2009 Jenkins ..... A47C 7/40 297/284.7 X
7,625,046 B2 * 12/2009 Sanchez ..... A47C 7/402 297/284.4 X
8,596,716 B1 12/2013 Caruso
9,131,775 B1 * 9/2015 Eisenberg ..... A63B 23/0211
10,085,562 B1 * 10/2018 Labrosse ..... A47C 7/727
10,272,282 B2 * 4/2019 Harlow ..... A47C 1/022
10,667,612 B2 * 6/2020 Matlin ..... A47C 7/006
10,827,841 B1 * 11/2020 Tsai ..... A47C 7/402
2002/0093233 A1 * 7/2002 Chu ..... A47C 7/46 297/284.4
2003/0184139 A1 * 10/2003 Sloan, Jr. ..... A47C 7/462 297/284.4
2012/0032484 A1 * 2/2012 Cvek ..... A47C 7/441 297/311
2012/0193959 A1 * 8/2012 Chen ..... A47C 7/46 297/301.1
2013/0113249 A1 * 5/2013 Cvek ..... A47C 31/00 297/217.2
2013/0134755 A1 * 5/2013 Vestergaard ..... A47C 9/002 297/284.4
2014/0125101 A1 * 5/2014 Hong ..... B60N 2/0232 297/284.4
2014/0125103 A1 * 5/2014 Suzuki ..... B60N 2/6673 297/284.7
2014/0210240 A1 7/2014 Muck et al.
2015/0115679 A1 4/2015 Muck
2015/0305506 A1 * 10/2015 Suzuki ..... A47C 7/462 297/284.4
2015/0305961 A1 * 10/2015 Broerman ..... A47C 7/004 601/115
2016/0022044 A1 * 1/2016 Leonard ..... A47C 7/14 297/285
2017/0340496 A1 11/2017 Hochman et al.
2018/0360218 A1 12/2018 Labrosse et al.
2020/0352337 A1 * 11/2020 van der Heyden .. A61G 5/1056

* cited by examiner

ADJUSTABLE DESK CHAIR

CROSS-REFERENCE TO RELATED APPLICATIONS

This application claims priority to U.S. Provisional Application No. 62/905,173, filed on Sep. 24, 2020. The foregoing patent application is herein incorporated by reference.

FIELD OF INVENTION

The present invention relates to an adjustable chair with a number of adjustable features so as to provide an automated adjustable seating position for a user. In some instances, the seating position may be automatically adjusted throughout the day so as to provide changed seating positions that promote movement and improve posture. In some instances, the seating position(s) may be established according to "best practice" positions established by medical professionals which are automatically communicated to the adjustable chair so as to move the user to new and proposer posture positions throughout the day.

BACKGROUND

Currently, there are a variety of office chairs or other chairs available. Many of these chairs offer some ability to change their position or height so as to provide a user with the most comfortable seating position. Despite these options, users typically find that ensuring a comfortable configuration of an adjustable chair is a tedious process, requiring excessive manual adjustment and readjustment. As such, there is a need for an efficient and elegant adjustable chair that will provide increased adjustability and personalization in an efficient and user-friendly manner.

Further, another difficulty with adjustable chairs is that the difficulty and tedious nature of adjusting the chairs discourages users from making adjustments throughout a workday. Rather, users are likely to set an a single "ideal" chair setting, often at the time that they initially use the chair, and use that single setting for a large period of time. This discourages the movement and constant movement that promotes proper back health. Further, most users do not know which settings would most likely lead to improved postures and best practices.

The subject matter claimed in the present disclosure is not limited to embodiments that solve any disadvantages or that operate only in environments such as those described above. Rather, this background is only provided to illustrate one example technology area where some embodiments described in the present disclosure may be practiced.

BRIEF SUMMARY

According to one aspect of the invention, an adjustable chair is described. The adjustable chair includes a seat part, a seat back disposed along one side of the seat part, the seat back being configured for supporting at least a person's back or shoulders, a chair base configured for being placed on a floor, at least one adjustable chair feature including a motor capable of being selectively controlled and driven so as to adjust at least one of: the rotation or tilt of the seat part, a vertical distance between the seat back and the one side of the seat part, an angle position between the seat back and the seat part, and a distance between the chair base and the seat part.

Another aspect of the invention is an adjustable chair comprising a seat part, a seat back disposed along one side of the seat part, the seat back being configured for supporting at least a person's back or shoulders, a chair base configured for being placed on a floor, and a linear actuator connected at one end to the chair base and to the seat part, the linear actuator comprising a motor, an inner locking guide, a middle locking guide, and an outer locking guide, wherein the linear actuator moves between an expanded and collapsed state as the motor is driven so as to increase and decrease a distance between the seat part and the chair base, and wherein the inner locking guide, middle locking guide, and outer locking guide are configured so as to prevent rotation with respect to each other as the motor is driven.

A third aspect of the invention is a linear actuator comprising a motor, an inner locking guide, a middle locking guide, and an outer locking guide, wherein the linear actuator moves between an expanded and collapsed state as the motor is driven so as to increase and decrease a distance between distal ends of the inner locking guide and the outer locking guide, and wherein the inner locking guide, middle locking guide, and outer locking guide are configured so as to prevent rotation with respect to each other as the motor is driven.

The objects and advantages of the embodiments will be realized and achieved at least by the elements, features, and combinations particularly pointed out in the claims.

Both the foregoing general description and the following detailed description are given as examples and are explanatory and are not restrictive of the invention, as claimed.

BRIEF DESCRIPTION OF THE DRAWINGS

Example embodiments will be described and explained with additional specificity and detail through the use of the accompanying drawings in which.

DETAILED DESCRIPTION

Figure 1A:
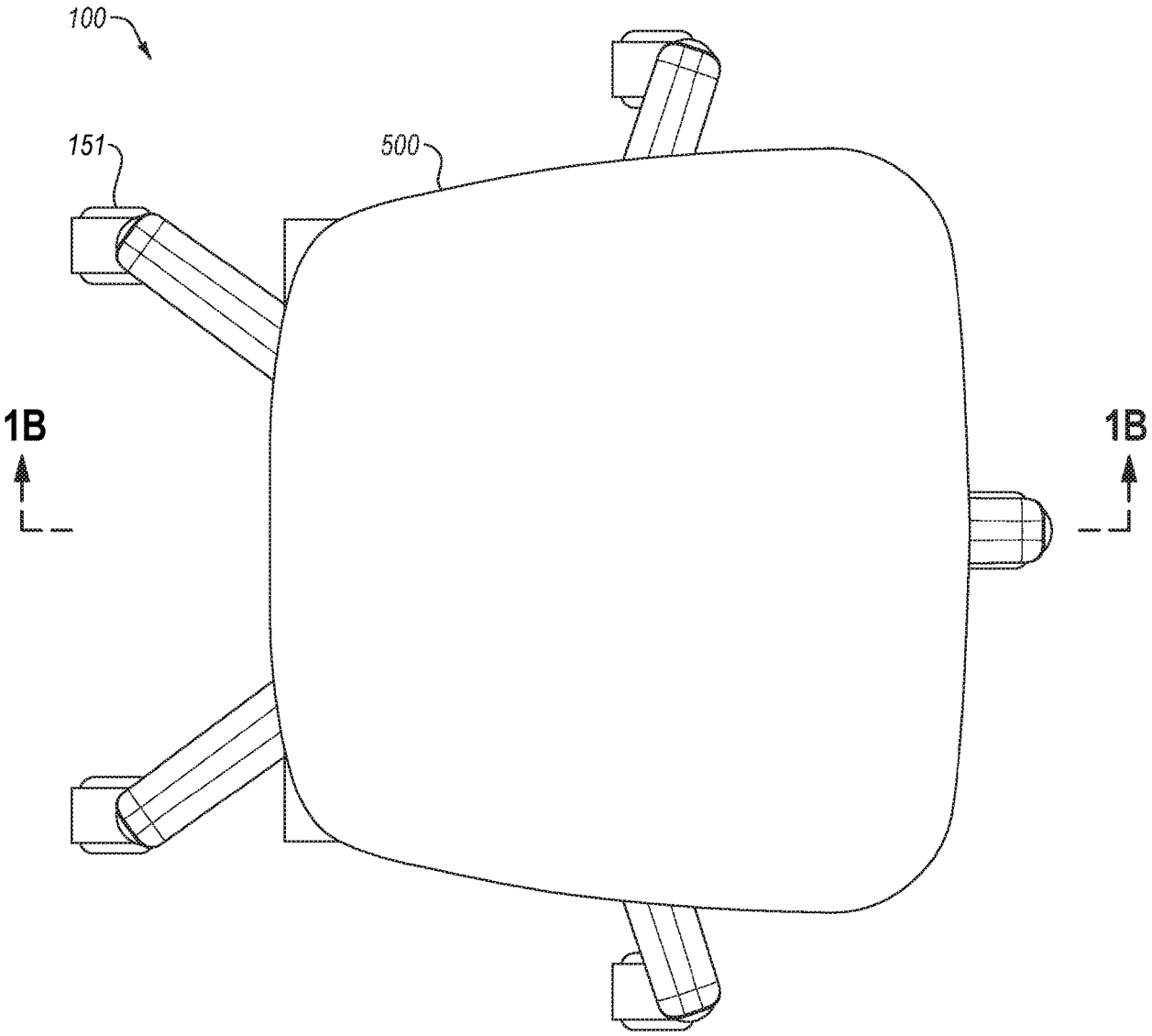
FIGS. 1A-1E and 2A-2E illustrate various aspects of a linear actuator according to some embodiments of the invention.

The embodiments discussed in the present disclosure are related to an adjustable chair that includes a number of different adjustable features so as to provide a customizable seat. More specifically, embodiments described herein are directed to an adjustable chair that includes individually customizable components which may include a linear actuator for controlling the height adjustment of the chair with respect to the floor, an adjustable lumbar portion, a chair back configured with an adjustable back with respect to a seat cushion, and/or an adjustable seat cushion which is configured to be adjusted up, down, or tilted with respect to a horizontal axis. Finally, in some embodiments described herein, a motor control associated with each of the linear actuator, adjustable lumbar portion, adjustable chair back, and adjustable seat cushion may be controlled by a programmable interface so as to provide a user with a user interface for controlling each of these aspects via an electronic device, such as a smart phone or other user device. Further, using a memory associated with the device or the controller(s), the controller in some embodiments may associate a user with a personal profile so as to save their preferred chair position, which may then be used to adjust the chair automatically at, for example, different times of day and/or for a plurality of users. In some instances, the device or controller may also be in communication with an application which may include "best practice" positions established by, for example, a medical professional or other expert who may establish or recommend settings which help consistently and correctly adjust the various adjustable features of the adjustable chair into positions which promote back health and posture. In some instances, a user may use a device, such as a cellular phone, including an application operating on the cellular phone to have at least some portion of the "best practice" positions automatically implemented.

As may be understood by one of ordinary skill in the art, embodiments described herein may include any number or combination of the adjustable features described below and the individually adjustable features are described herein for illustrative purposes only.

Linear Actuator

Typically, a linear actuator is used to position two parts with respect to each other. Generally, linear actuators include a motor, a nut, and a threaded rod, with the nut and the threaded rod forming a screw mechanism. Using the control motor, the relative positions of two parts of the screw mechanism can be controlled. By attaching the nut to one part being controlled and the threaded rod to the other part being controlled, it is possible to use some means, such as the motor, to turn the nut, causing the threaded rod moves inside of the nut. If the two parts are constrained so that the two parts cannot rotate with respect to each other, driving the motor and causing the threaded rod to move inside of the nut in turn causes the two parts move with respect to one another.

One example of an application of a linear actuator is used to control air surfaces on an airplane wing. The lift requirement for a wing during landing and takeoff is much different than the air surface required during normal flight after the aircraft has gained sufficient velocity and elevation. To accommodate this difference, a linear actuator is used to insert more lifting surface during takeoff and landing into the wing. Conversely, during normal flight, the linear actuator causes a reduction in the amount of lifting surface.

FIGS. 1A-1E and 2A-2E illustrate various aspects of a linear actuator according to some embodiments. As may be understood, one aspect of this invention is the ability to control the relative positions of two parts of an adjustable chair using three nut and screw combinations. The benefit of using more than one screw and nut combination is the ability to make the actuator smaller, resulting in an actuating mechanism which is more compact. This is of great benefit for controlling the height adjustment for a chair with respect to the floor. Some embodiments of the invention could also be used outside of a chair environment in other linear actuator applications where a smaller package is required or desirable.

Figure 1B:
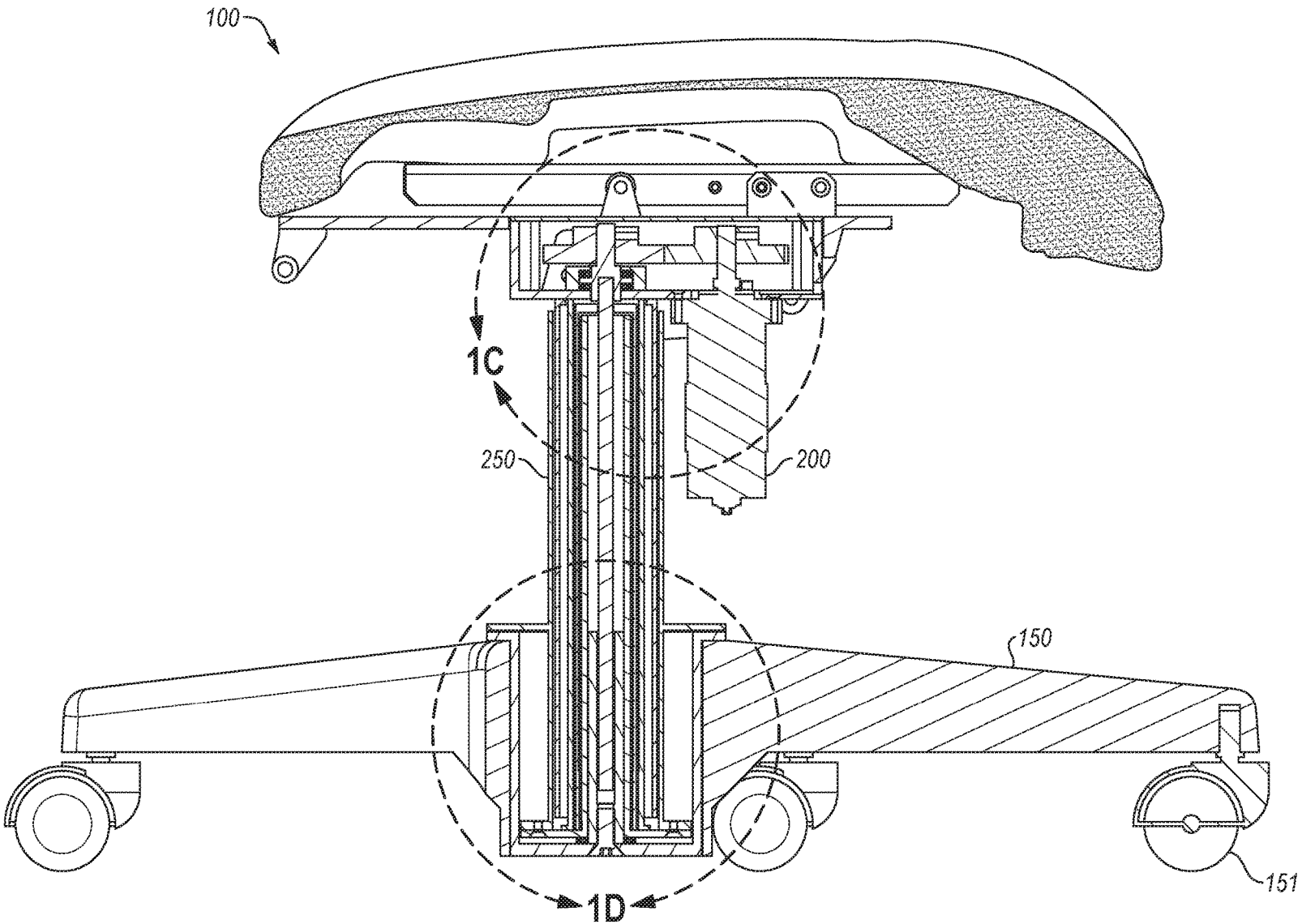
Figure 1C:
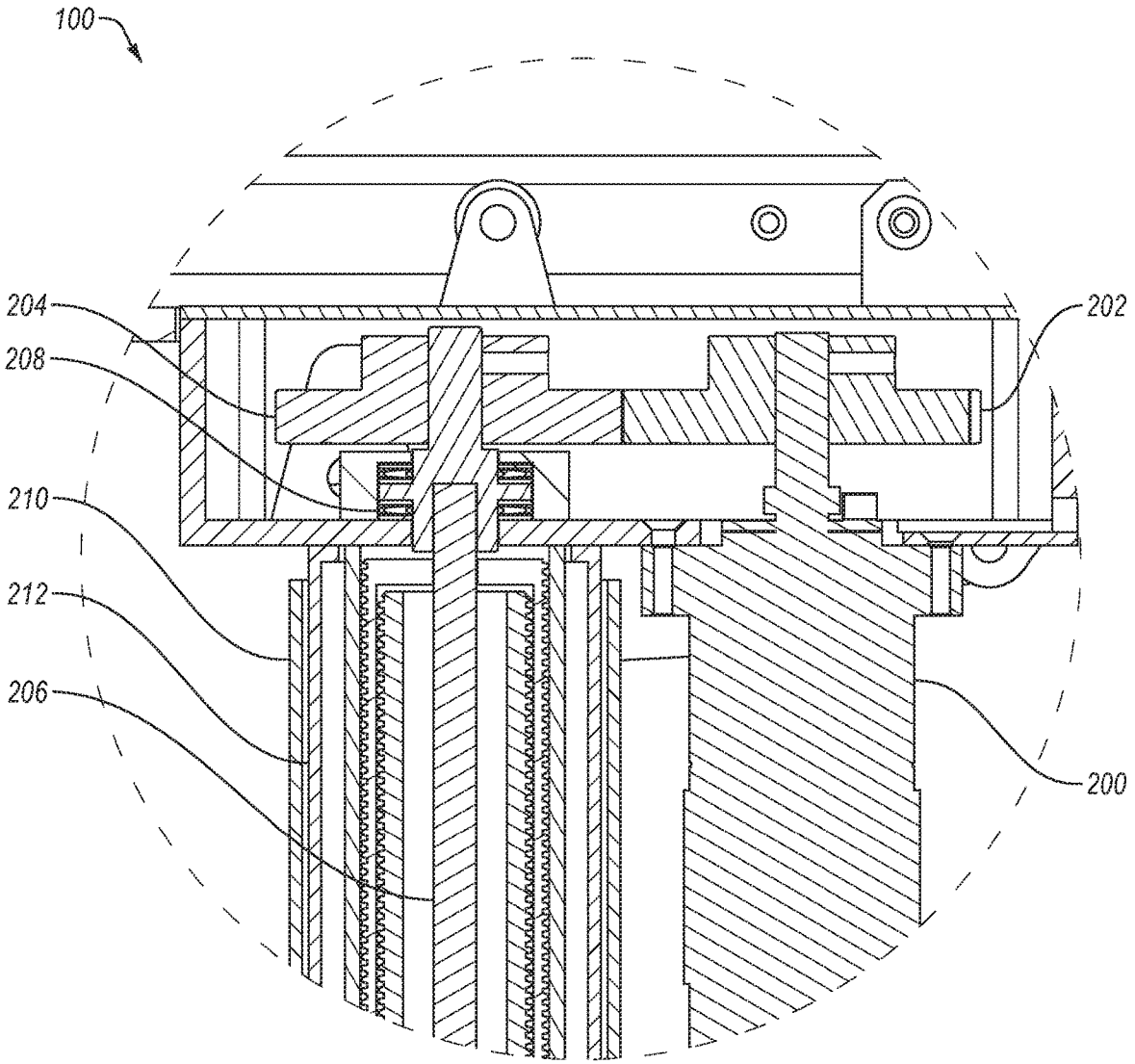
Figure 1D:
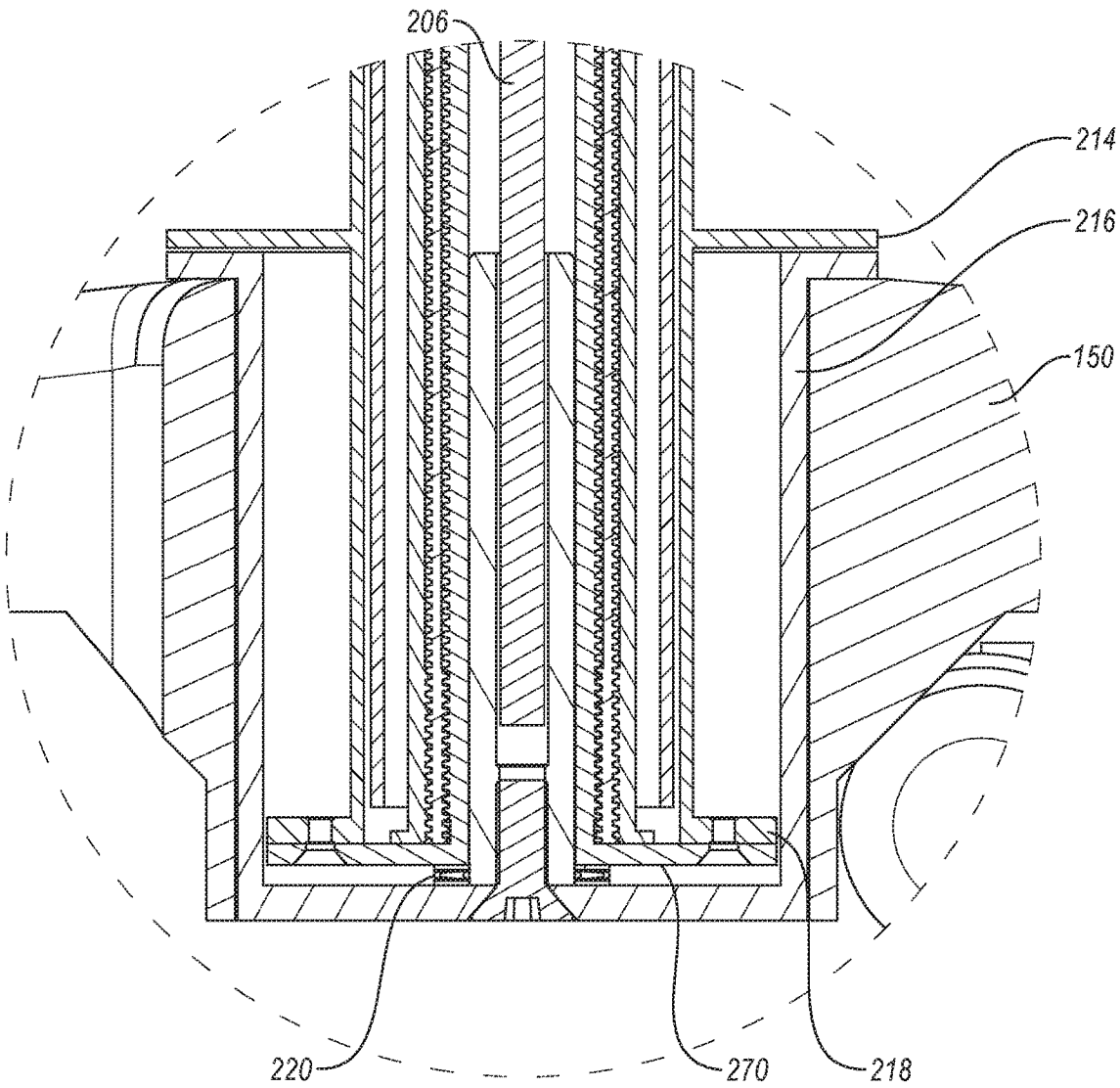
Figure 1E:
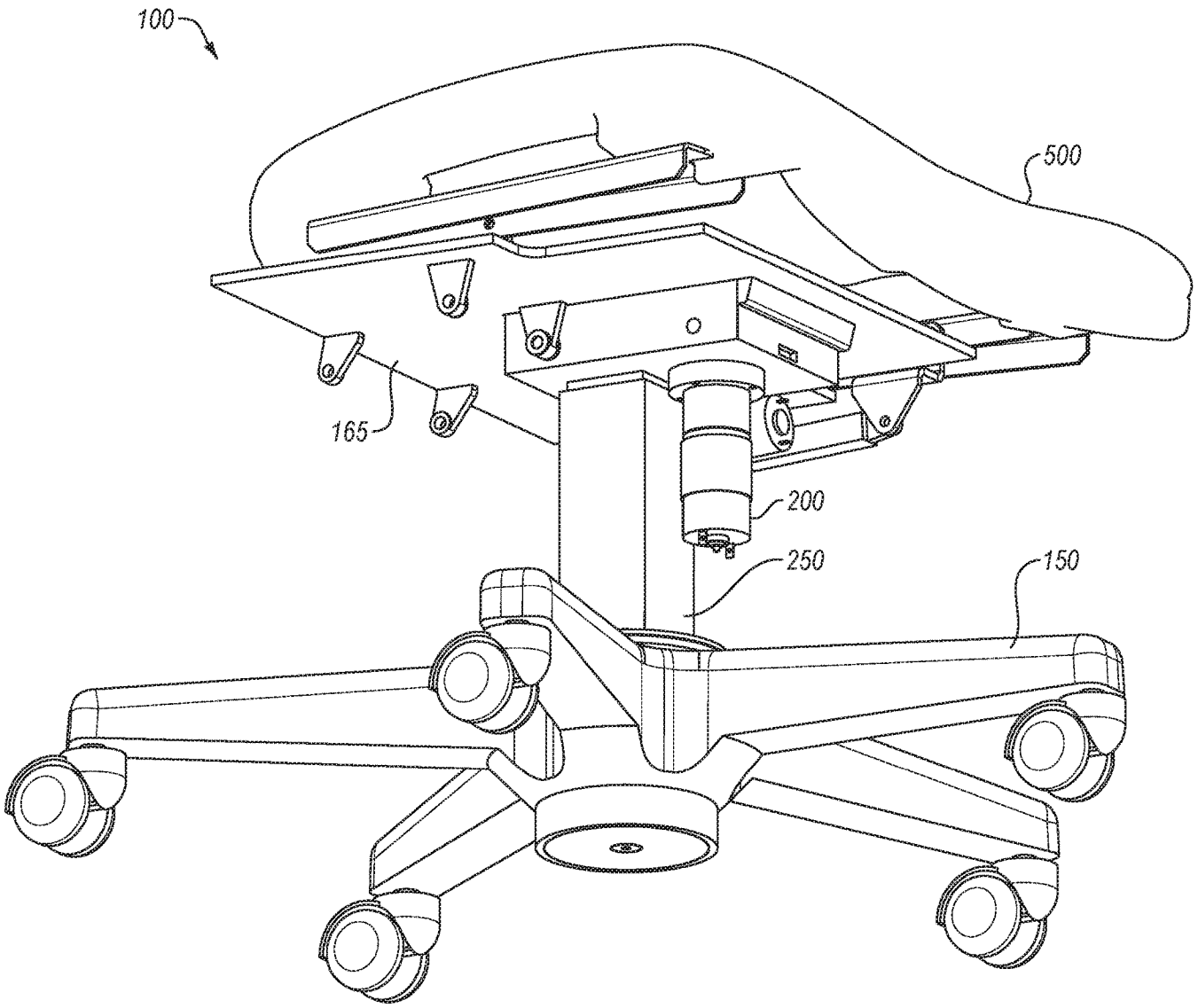
Figure 2A:
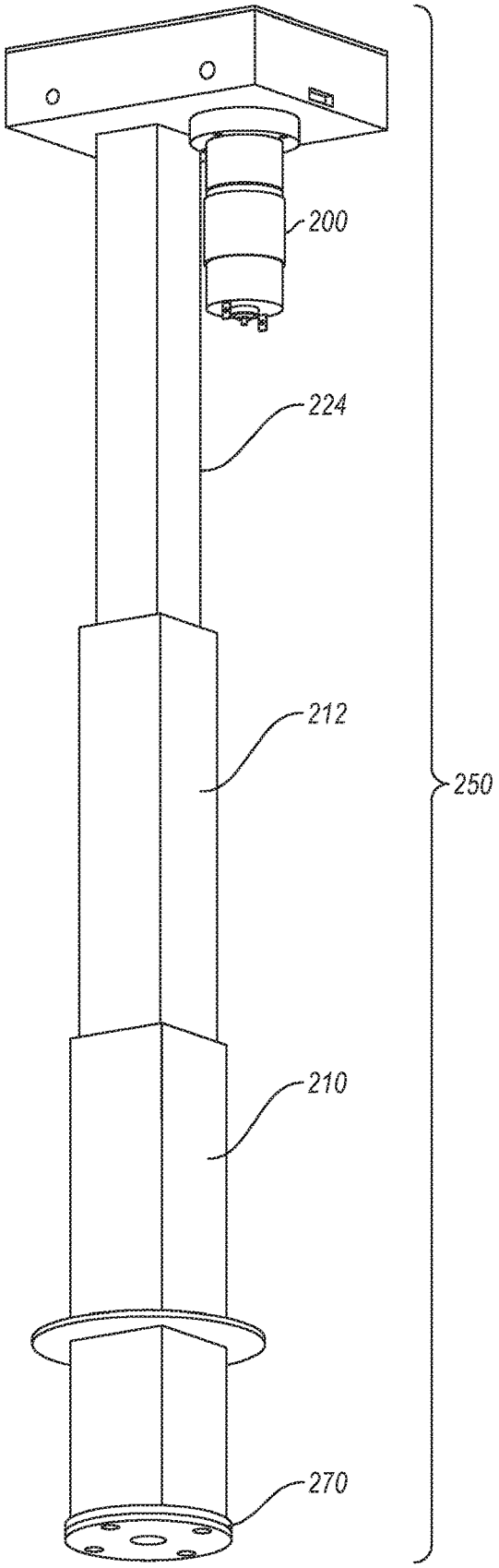
Figure 2B:
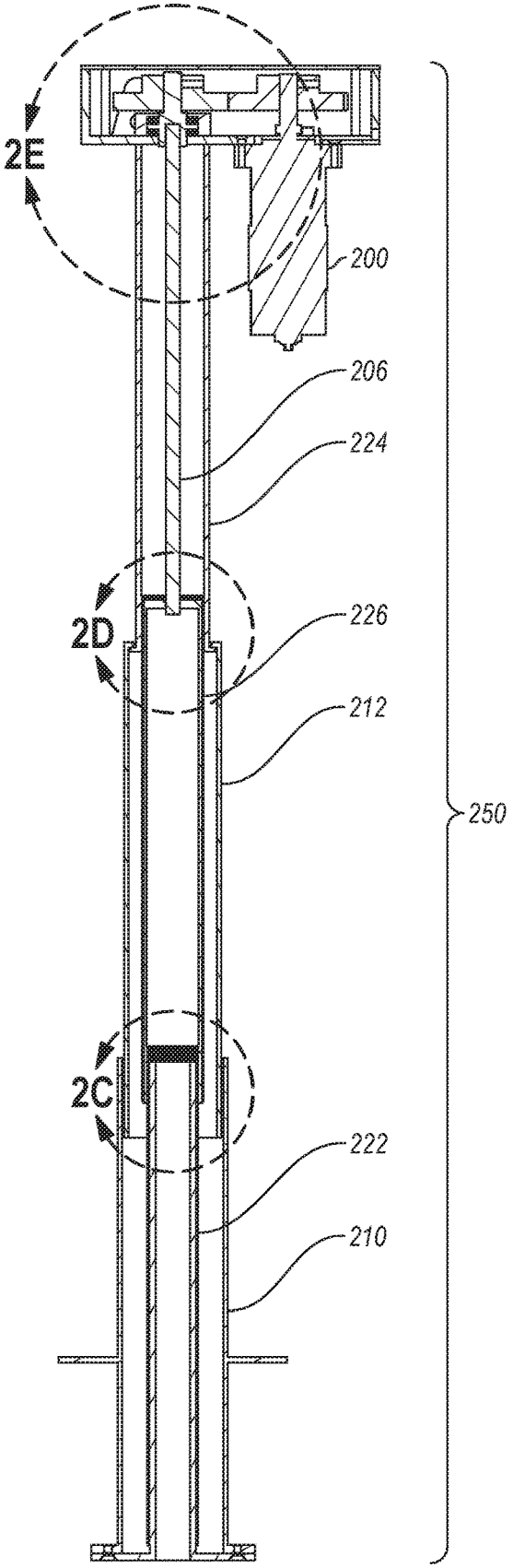
Figure 2C:
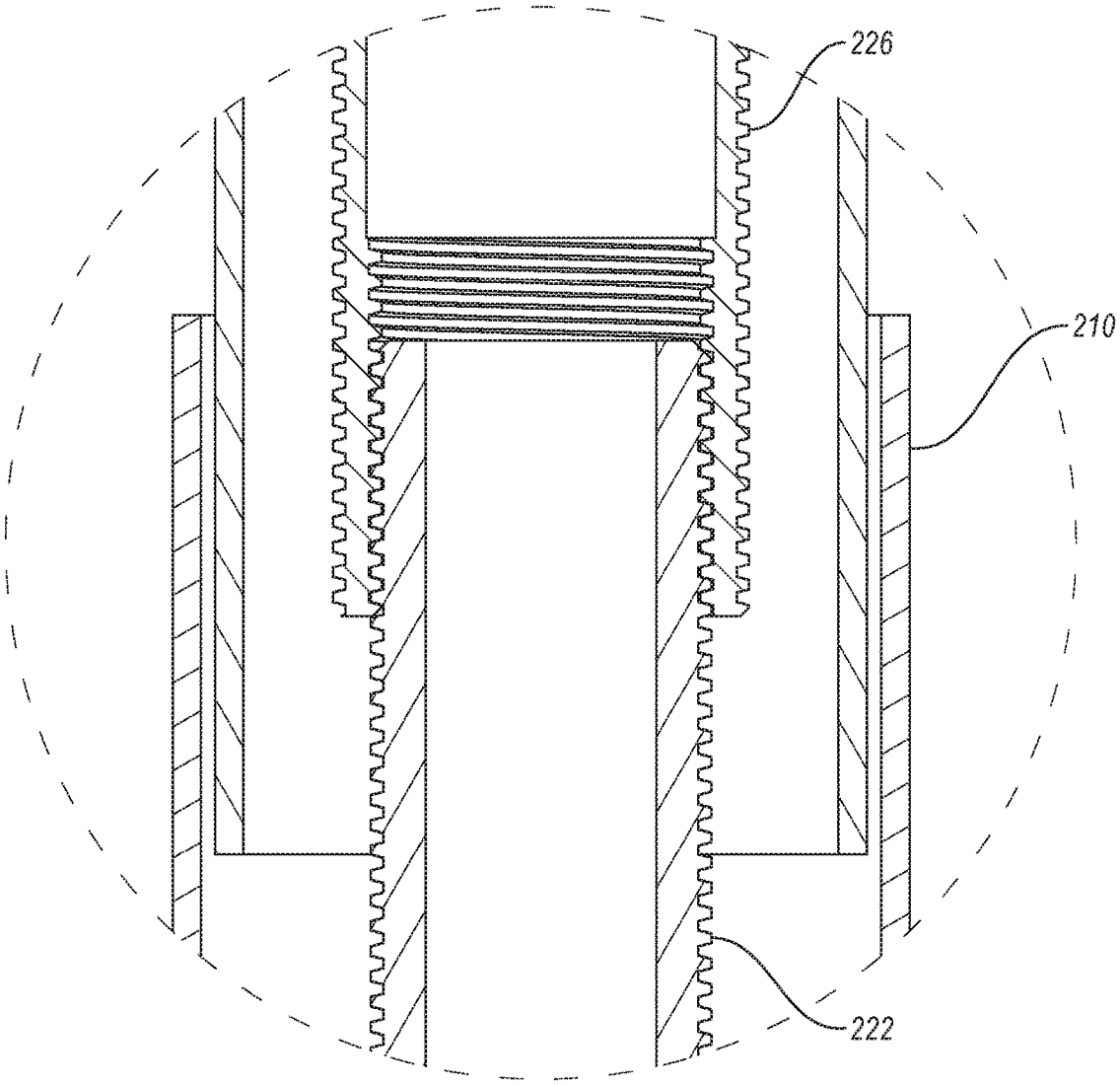
Figure 2D:
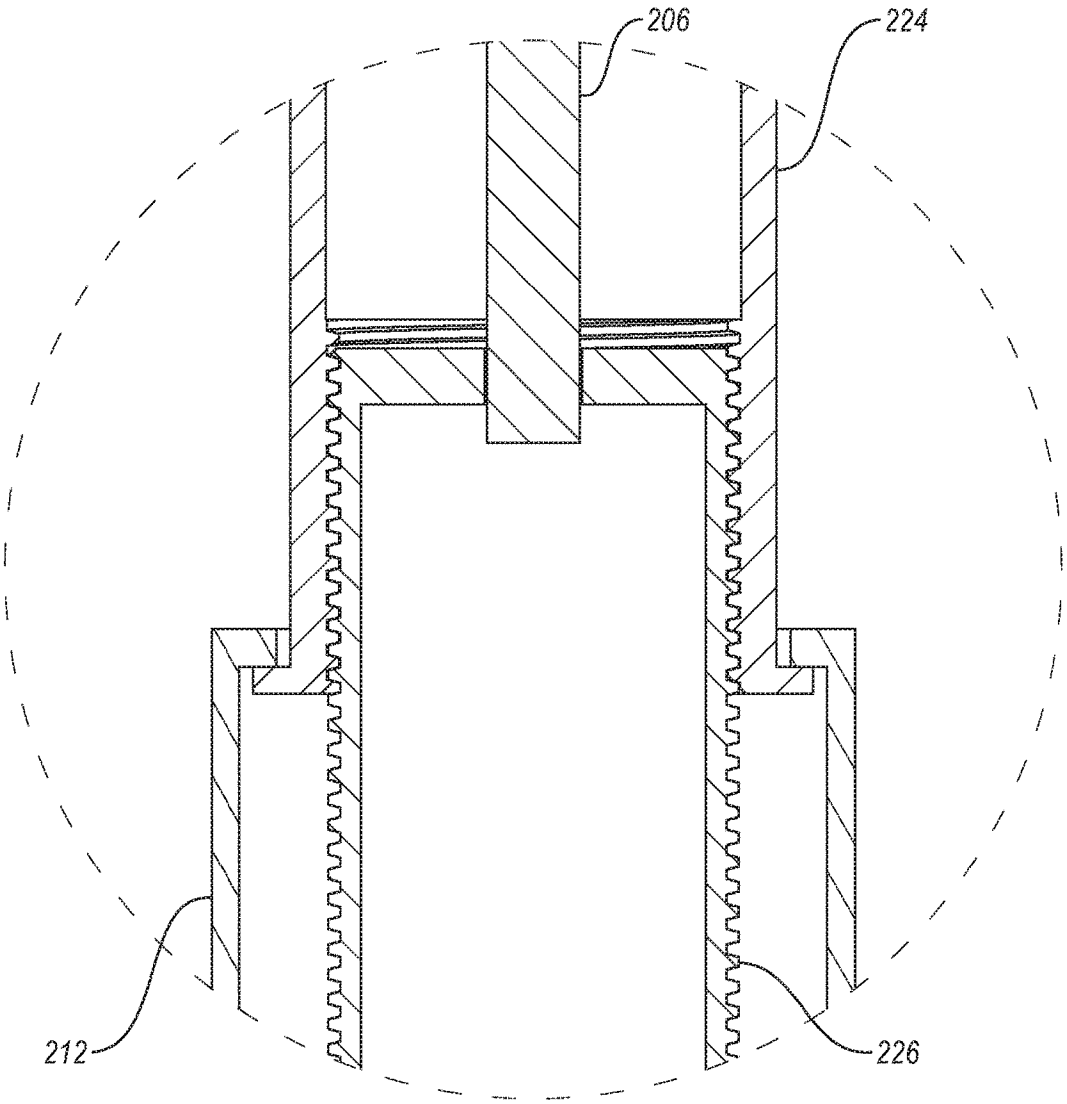
Figure 2E:
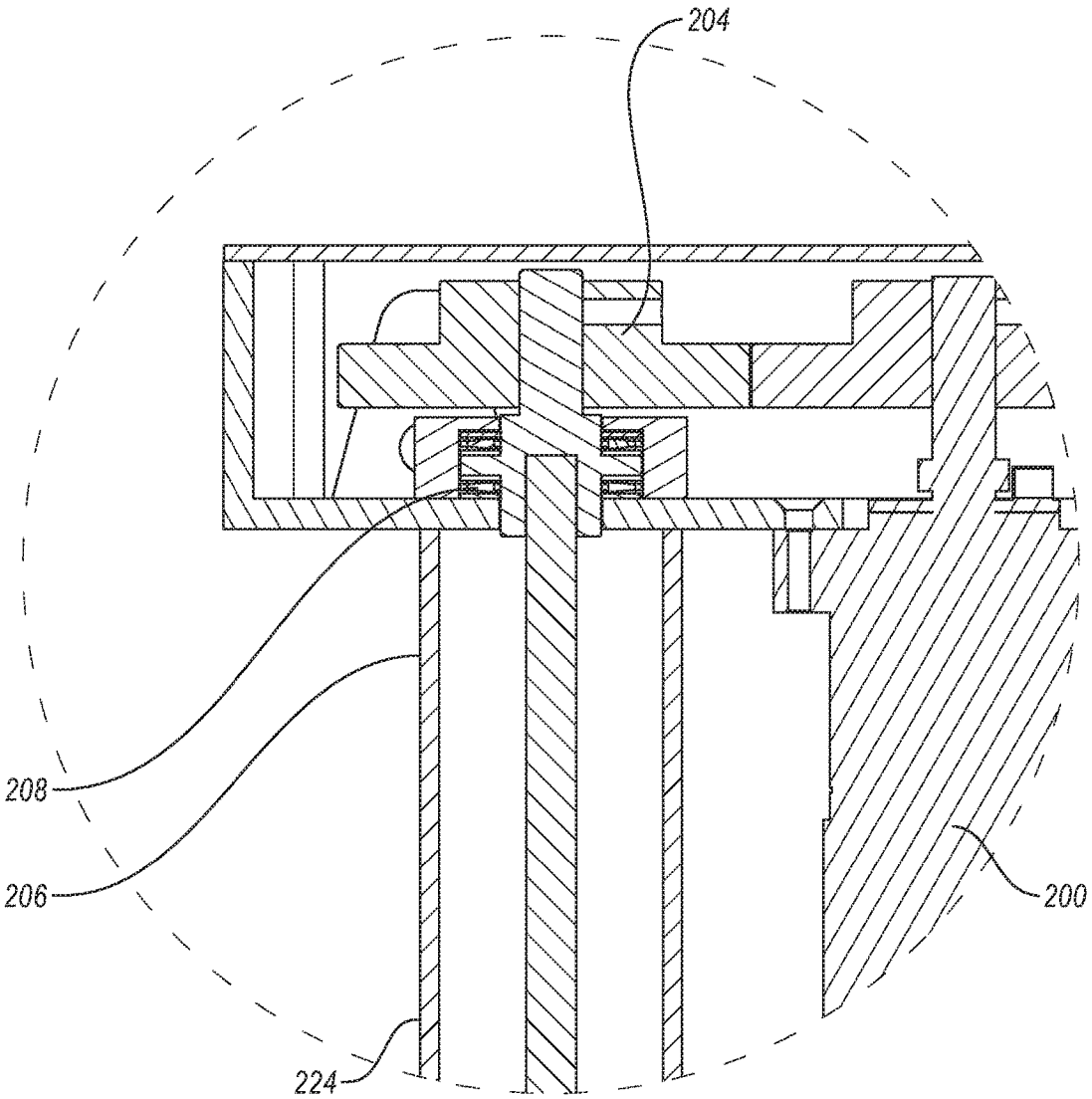
Figure 3A:
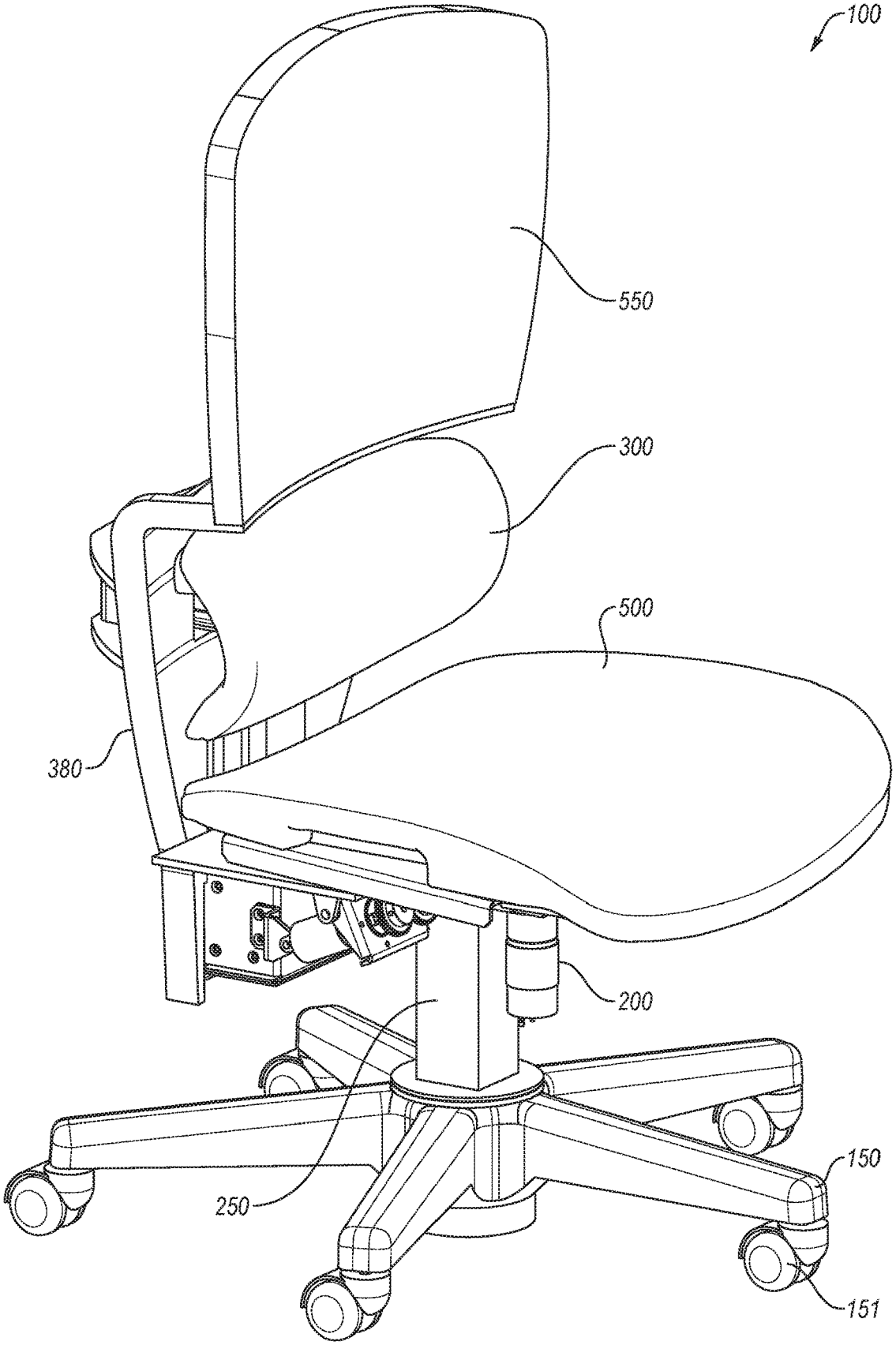
FIGS. 3A-3D illustrate an adjustable chair according to some embodiments of the invention which includes a number of adjustable features.
Figure 3B:
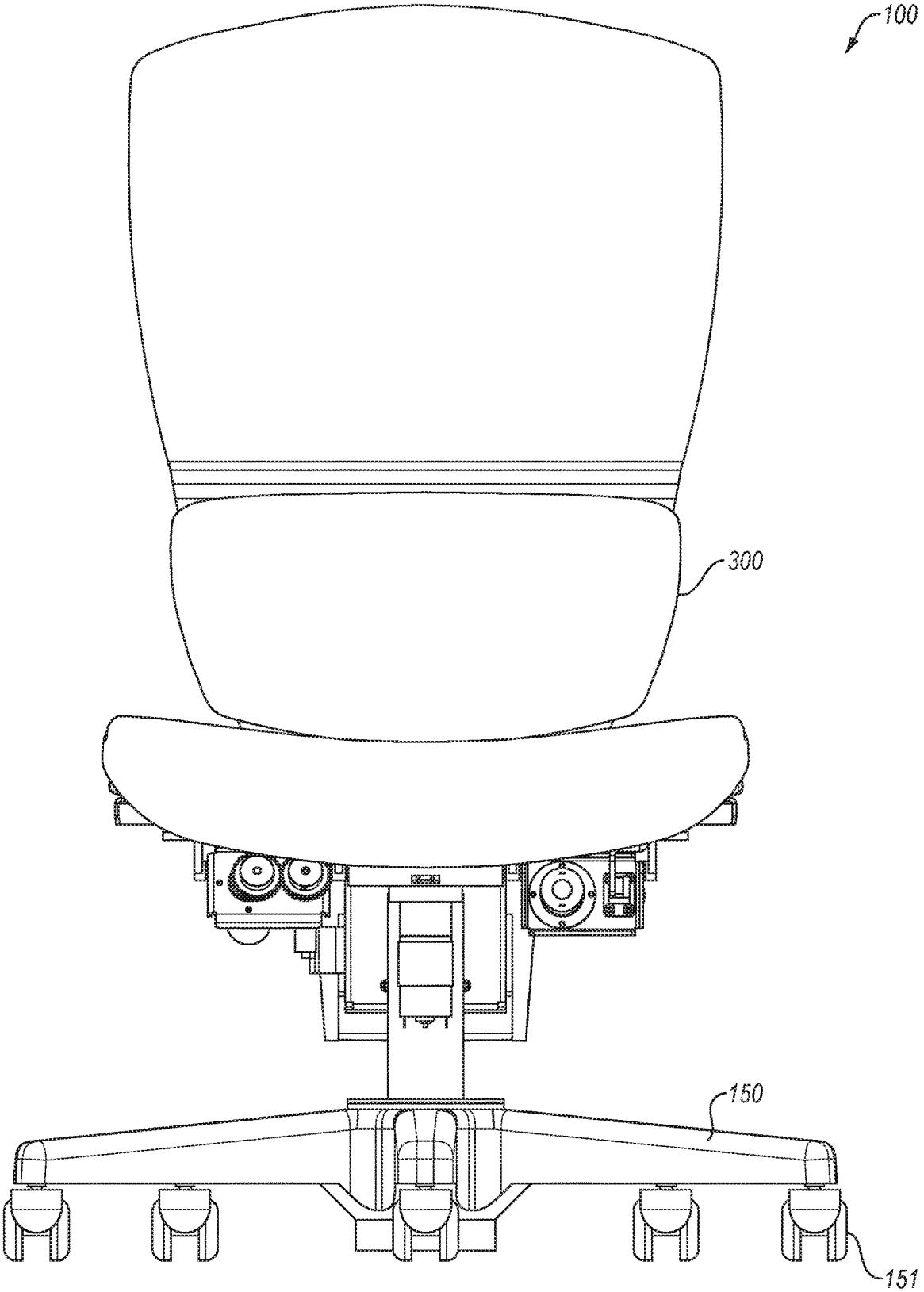
Figure 3C:
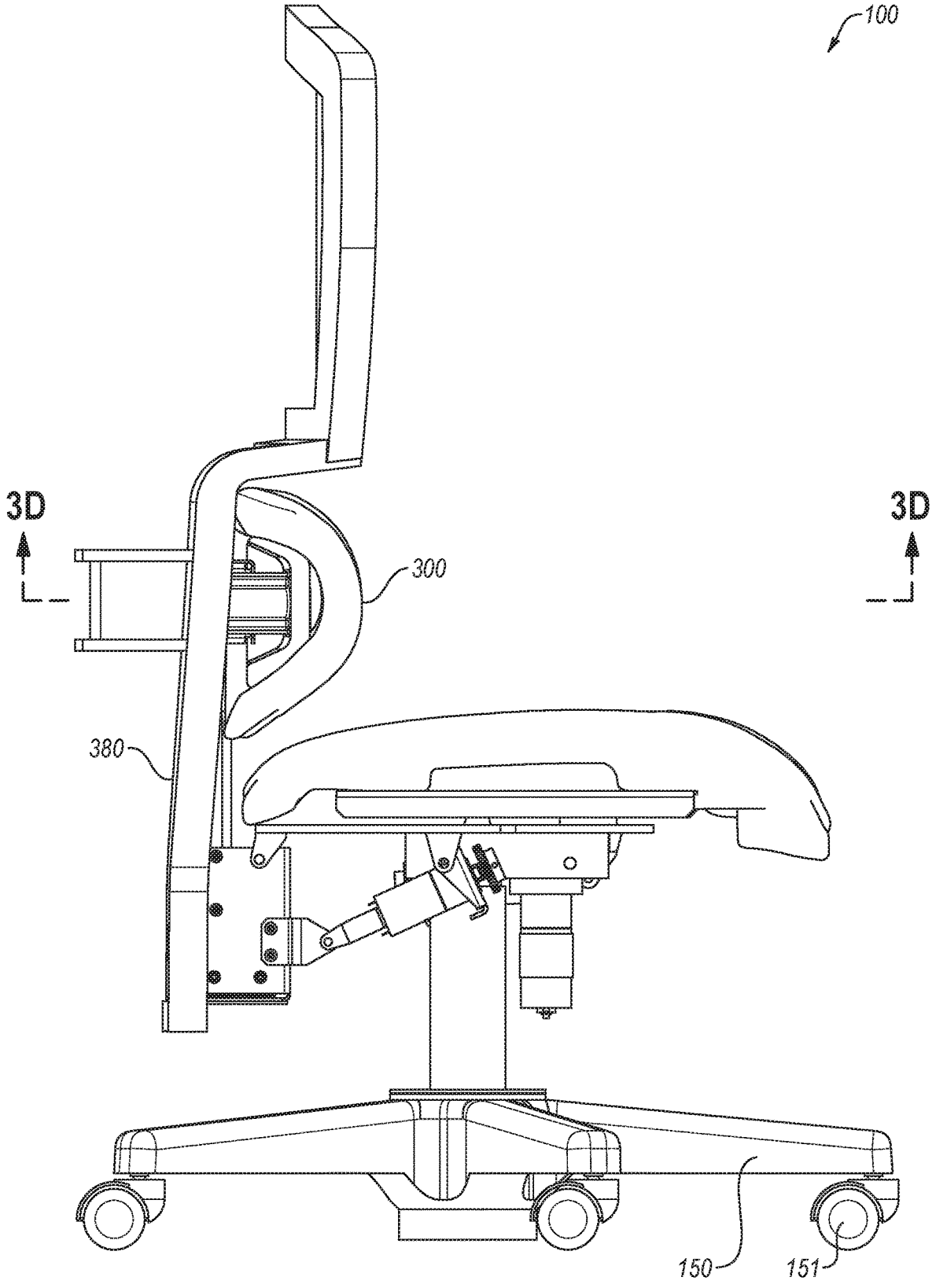

FIGS. 1A-1E and 2A-2E illustrate the linear actuator 250 according to one aspect of the invention. FIGS. 1A-1E illustrate a configuration where the linear actuator 250 is in a collapsed position. FIGS. 2A-2E illustrate a configuration where the linear actuator 250 is in an extended position. In the configuration illustrated in FIGS. 1A-1E and 2A-2E illustrate the linear actuator 250 being used in an adjustable chair 100, although other applications of the linear actuator 250 may be used. Turning briefly to FIG. 3A, the adjustable chair 100 may include for example, a chair base 150, which may comprise a variety of configurations, including any number of support structures, which includes in some instances, wheels 151 which enable the adjustable chair 100 to be moved along a floor or other surface. In the Figures included herein, the wheels 151 comprise castor wheels although it should be understood that other configurations may be used without departing from the scope of the invention. As is shown in FIG. 3A, the adjustable chair may also include an adjustable lumbar support 300, an adjustable cushion 500, and an adjustable seat back 550, each of which will be described in greater detail below.

FIGS. 1A-1B and 1E illustrate the linear actuator 250 as attached to the cushion 500 and the chair base 150. FIGS. 2A-2B illustrate various components of the linear actuator 250 generally, including a motor 200, an inner locking guide 224, a middle locking guide 212, and an outer locking guide 210. FIGS. 1C and 2E illustrate some of the means by which the inner locking guide 224 and motor 200 are mounted to the cushion 500 portion of the adjustable chair 100. FIGS. 2C and 2D illustrate some of the interior connections between the inner locking guide 224, the middle locking guide 212, and the outer locking guide 210. FIG. 1D illustrates the connection between the outer locking guide 210 and the chair base 150.

FIG. 1C illustrates the manner in which the inner locking guide 224 is connected to a chair platform 165. As may be understood, the inner locking guide 224 is attached to the chair platform 165 such that the linear actuator 250 rotates with the adjustable chair 100. This prevents any adjustment from taking effect in the linear actuator 250 when a person sitting in the adjustable chair 100 rotates the adjustable chair 100 with respect to the chair base 150. As is shown in FIG. 2E, a thrust bearing 208 is positioned so as to accommodate the vertical loads as well as allowing the linear actuator 250 to rotate with respect to the chair base 150. Thus, any rotation of the seat with respect to the chair base 150 does not adjust the height of the linear actuator 250.

The linear actuator 250 includes a motor 200, a driving gear 202 and a driven gear 204, which in turn cause a drive shaft 206 to rotate. As may be understood, by rotating the drive shaft 206 while controlling the position of an inner screw 222, a middle screw 226, and an outer screw comprising a portion of the inner locking guide 224. More particularly, one aspect of the invention is controlling the inner screw 222, middle screw 226, and outer screw (included here as a portion of the inner locking guide 224) can be controlled so that they do not rotate with respect to each other. In this example, the inner screw 222 and outer screw 224 are constrained from rotating using an outer circumference of the inner locking guide 224, middle locking guide 232, and outer locking guide 210 comprising a square shape. As may be understood, the outer circumference of the inner locking guide 224, middle locking guide 232, and the outer locking guide 210 do not need to be square; they could be elliptical or any other shape that prevents rotation with respect to each other and other elements of the linear actuator 250.

As is shown more clearly in FIG. 1D, it can be observed that the outer locking guide 210 has a circular ring 270 at the bottom thereof which attaches to the inner locking guide 224 when the in the non-extended position which constrains the two locking surfaces from rotating together. Even though each of the inner locking guide 224, middle locking guide 232, and outer locking guide 210 have a square outer circumference, the diameter of a support pocket 216 of the chair base 150 is sufficient to allow the square elements to rotate inside the support pocket 216. The cover 214 shown in FIG. 1D is for decorative purposes so, for example, people cannot see the voids between the square tubes and the large cylinder. FIG. 1D also shows an inside guide 221 which is attached with a screw and which gives the linear actuator 250 vertical support to keep it erect and eliminate swaying.

FIGS. 2A-2E illustrate the various components of the linear actuator 250 in an extended position. The linear actuator 250 is controlled by a motor 200, which rotates a drive shaft 206, which in turn rotates the middle screw 226 while keeping the inner screw 222 and outer screw 224 locked from rotation. The middle screw 226 has an opposite thread on its interior and exterior surfaces. As such, by rotating the middle screw 226, the inner locking guide 224 and the outer locking guide 210 move in opposite directions. Therefore, by changing the rotation direction of the motor 200, the linear actuator 250 can collapse or extend. As may be understood, by rotating the motor 200, the linear actuator 250 is capable of performing a telescoping function, wherein the components of the linear actuator 250 slide into themselves into the compacted configuration shown in FIGS. 1A-1E and then are capable of expanding into the expanded position shown in FIGS. 2A-2E.

In a typical linear actuator, which comprises only a nut and screw, the thread on the nut does not have to be as long as the thread on the screw. In the embodiment described herein, the nut actually comprises a part of the screws; therefore, the part of the thread that is acting as the nut does not have to be full length of the different parts. This allow for less expensive machining during fabrication. The nut function is located on the inside of the different members thus making it easier or more economical to machine. Notice that the bottom screw has a full-length screw on the outside. The inner shaft has a short thread on the inside of the middle screw 226 which acts as the nut. The middle screw 226 has a full-length thread on the outside and a short thread on the inside of the upper screw. This design will accommodate a full extension and full collapse for the linear actuator 250 as well as providing an infinite number of height positions for the chair.

The drive shaft 206 has a non-round shape which could be rectangular, square or oval so that it can rotate with respect to the inner locking guide 224. As the linear actuator 250 either raises or lowers, the drive shaft 206 slides with respect to the inner locking guide 224. For this presentation, the inner screw 222 and the inside guide 270 are combined into one part for convenience, but they would not have to be combined. Furthermore, in this embodiment the outer locking guide 210 and the outer screw are combined into a single part, but they also need not be combined.

In some embodiments, for the linear actuator 250 to operate properly, the inner screw 222 and the outer screw 224 must be locked together so that they cannot rotate independently. To facilitate this there is a middle locking guide 232 that telescopes with respect to the inner locking guide 224 and outer locking guide 210. FIG. 2D illustrates how the middle locking guide 232 is pulled up to maintain that locking function.

As may be understood, one result of the embodiment described herein is that the adjustable chair 100 can be design which has a normal height for a regular desk in an office and can be raised to accommodate a higher desk. This particular design allows for a chair to be raised or lowered around 20 inches to accommodate the different desks in an office environment. For example, the embodiments herein are capable of adjusting so as to be used at both a sitting desk height in addition to a standing desk height. This is achieved by using a three-section linear actuator. In contrast, adjustable chairs which are currently known are capable of adjustable of between 4-5 inches, and thus are not capable of being used in both a sitting and a standing desk configuration.

Figure 9:
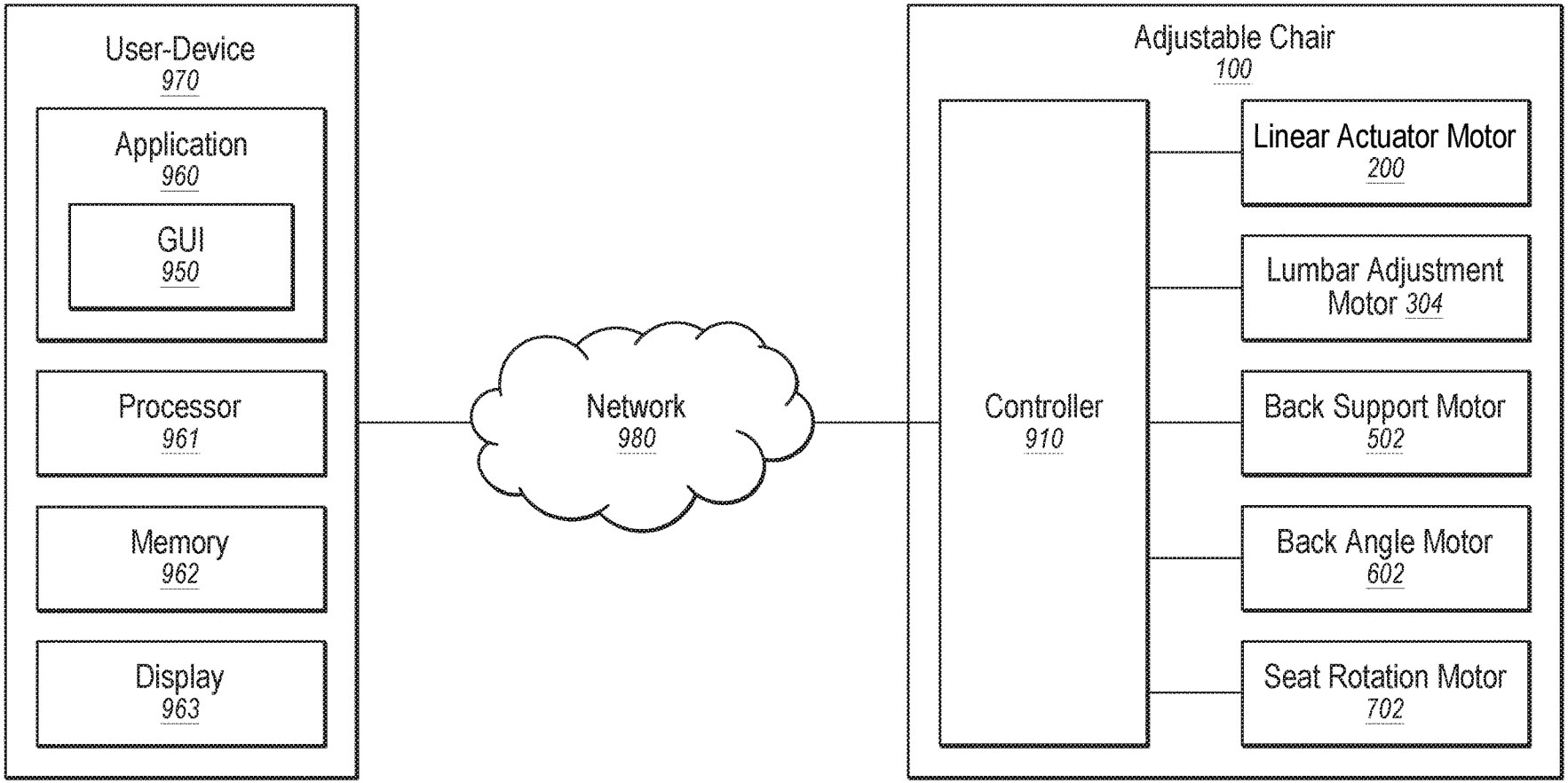
FIG. 9 illustrates the ability for a user to operate various adjustable features of the adjustable chair via a user device connected to a controller of the adjustable chair via a network according to some embodiments.

As is described more fully below with respect to FIG. 9, in some embodiments the linear actuator motor 200 described above may be controlled by a controller 910 which is connected to the linear actuator motor 200 by any number of mechanical or electrical means and which may act to drive the linear actuator motor 200 so as to cause the linear actuator 250 to move between the collapsed and expanded position, so as to effectively and electronically cause the height of the chair seat with respect to the floor to be adjusted. More particularly, as is shown in FIG. 9, a user may use a user device 970 including, for example, an application 960 may cause a graphical user interface (GUI) 850 to be displayed to a user via a display 963 of the user device 970 which allows the user to use GUI 950 to send communications with the controller 910 via, for example, a network 980 such as the internet or other communication network, including a Local-Area Network. In some the communication network may be a short-range wireless network such as Bluetooth® or other means of communication. As is described more fully below, in some instances, the application 960 may also enable the user to create a user profile with preferred user preferences or "best practice" settings for back health and posture recommended by an expert and presented to the user and selected by the user via the application 920. In such instances, the user is able to interact with the GUI 950 of the application 960 so as to cause the controller 910 to selectively or automatically drive the linear actuator motor 200 according to user preferences or "best practice" settings, which in turn causes the linear actuator to move between the collapsed and expanded position according to the user's instructions and preferences. In some instances, this user profile may be stored in a memory 962 of the user device 970. Consequently, rather than requiring the user to readjust the chair each time, the user may create a user profile which is stored in the memory 962 which may be used to communicate with the controller 910 and selectively drive the linear actuator motor 200 so as to automatically adjust the seat height of the adjustable chair 100 to the user's preferred level. Further, the user profile may be customized in any number of ways, including, for example, enabling a user to have different preferred settings at different times of the day.

As may be understood, by enabling the user to communicate with the controller 910 using a user device 970, embodiments herein allow the user to adjust the adjustable chair 100 to their preferred settings without requiring the user to mechanically adjust it themselves.

Adjustable Lumbar Portion

FIGS. 3A-3D, FIGS. 4A-4D, and FIG. 5A-5D illustrate another adjustable aspect of the adjustable chair 100. More particularly, FIGS. 3A-3D, FIGS. 4A-4D, and FIG. 5A-5D illustrate an adjustable lumbar portion 300. FIGS. 3A-3D illustrate the lumbar portion 300 in a retracted position, whereas FIGS. 4A-4D illustrates the lumbar portion 300 in an extended position. As is illustrated in the Figures, the lumbar portion 300 can be adjusted in and out from the back surface or a back support 380. The amount of adjustment is measured from the lumbar portion 300 being flush with the back support 380 of the adjustable chair 100 to protruding out from the back support 380. In one embodiment, the range of adjustability for the lumbar portion 300 is up to four inches of total movement. As may be seen from FIGS. 3A-3D and 4A-3D, a lumbar adjustment motor 304 and various control associated movement components, including a guide 306, gears 308 and 310, a bearing 312, and a nut 314 may be used to position the lumbar portion 300 at any position from zero to four inches.

Figure 3D:
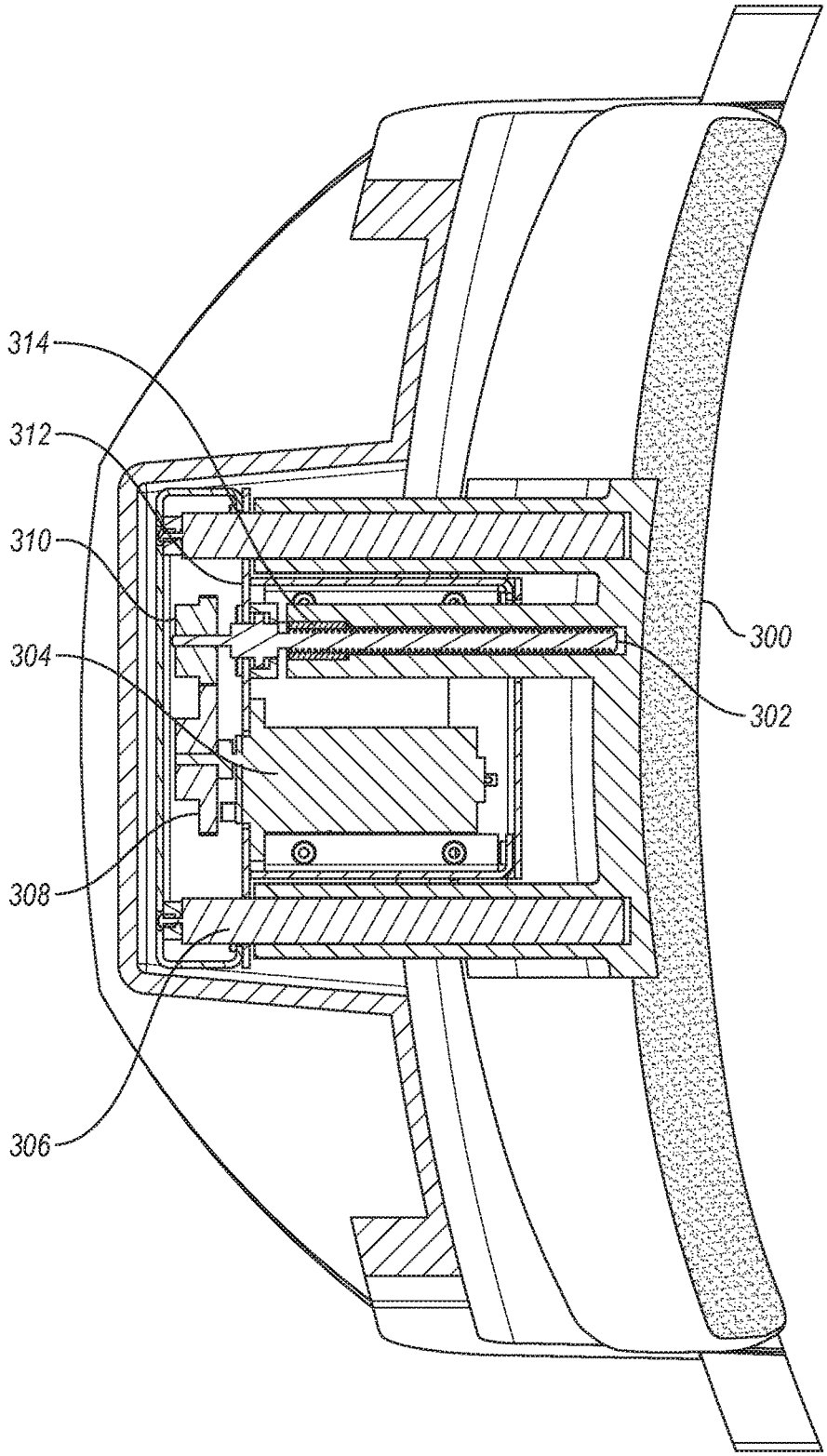
Figure 4A:
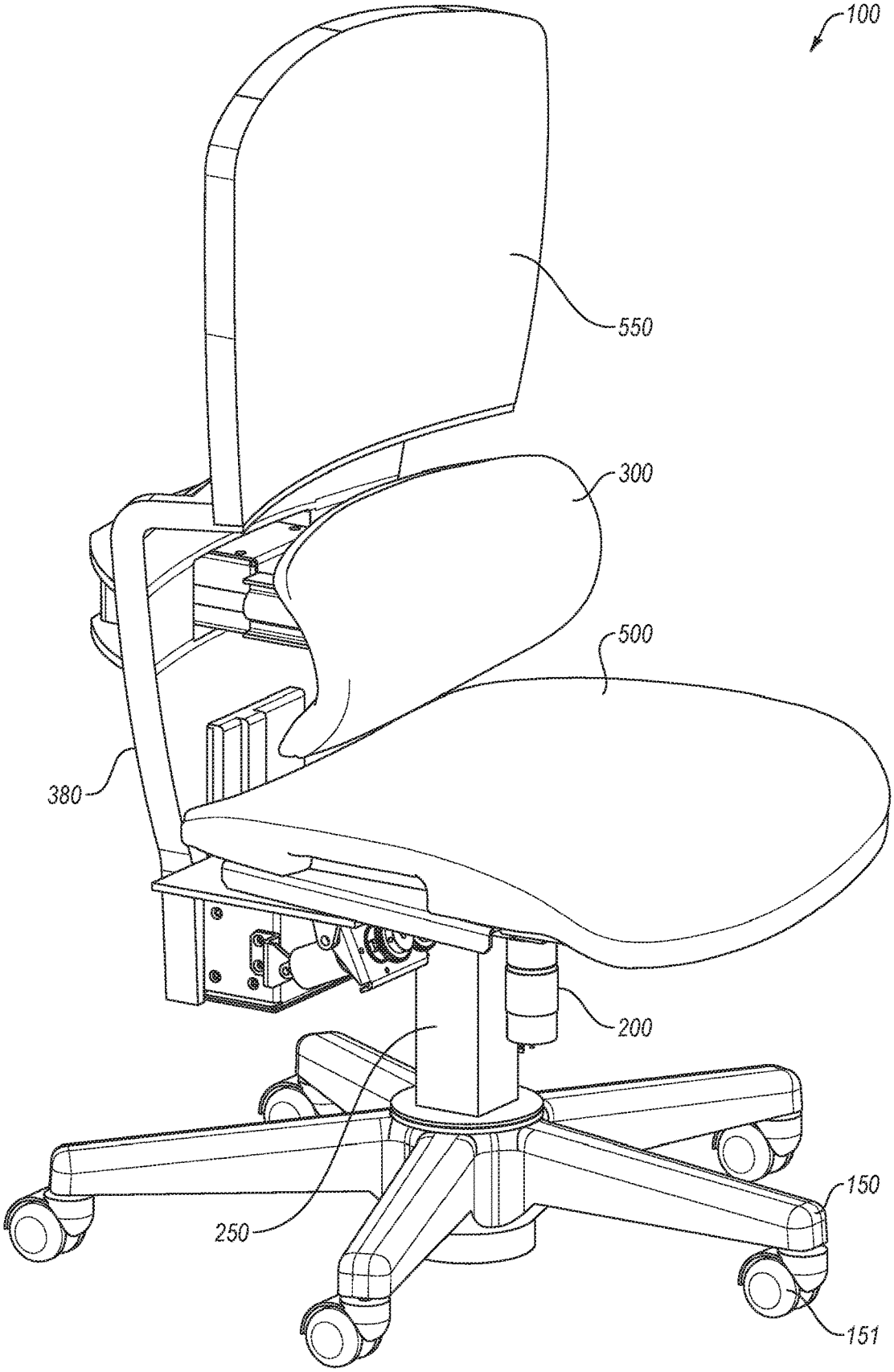
FIGS. 4A-4D and 5A-5D illustrate the adjustable lumbar feature of the adjustable chair according to some aspects of the invention.
Figure 4B:
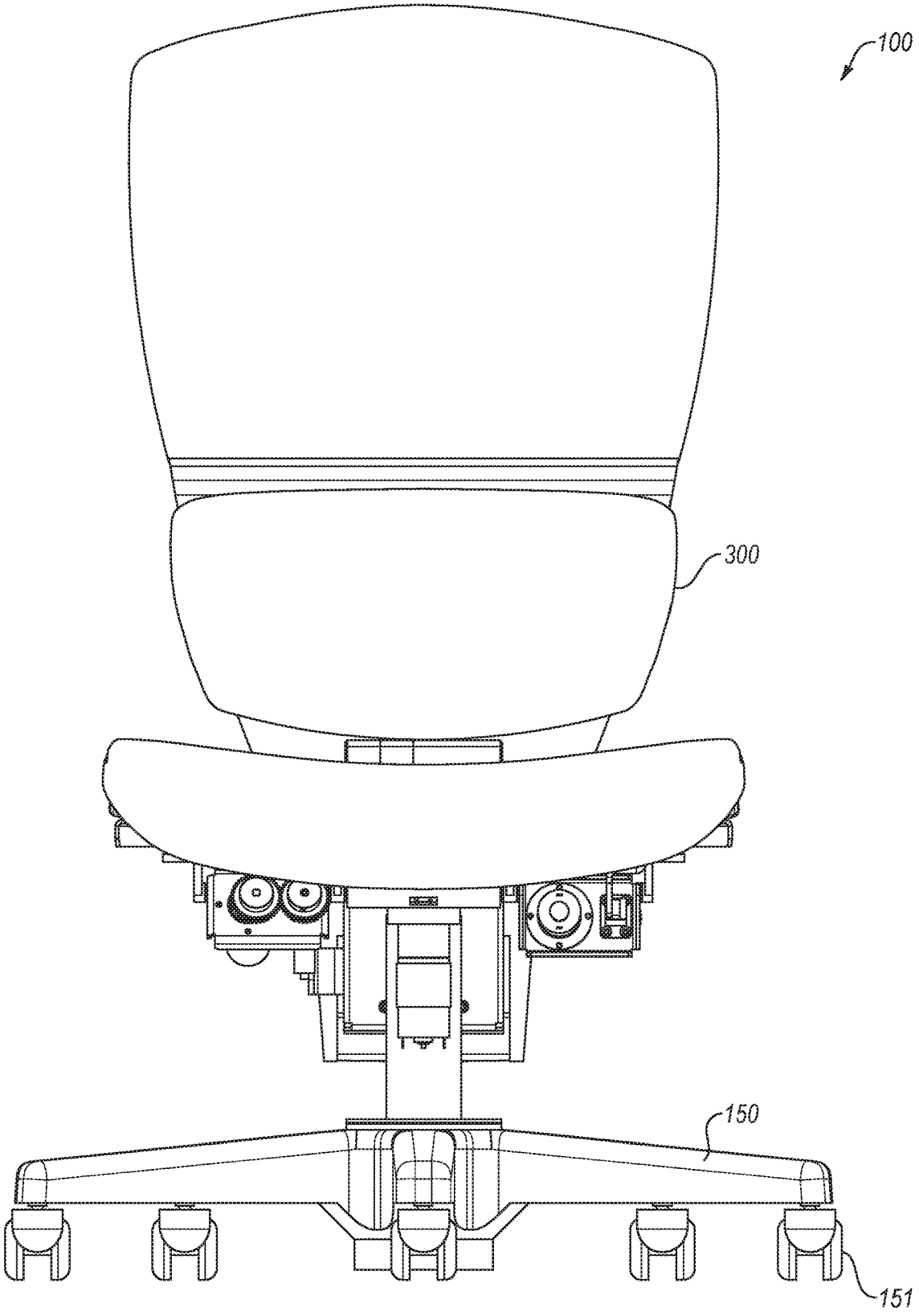
Figure 4C:
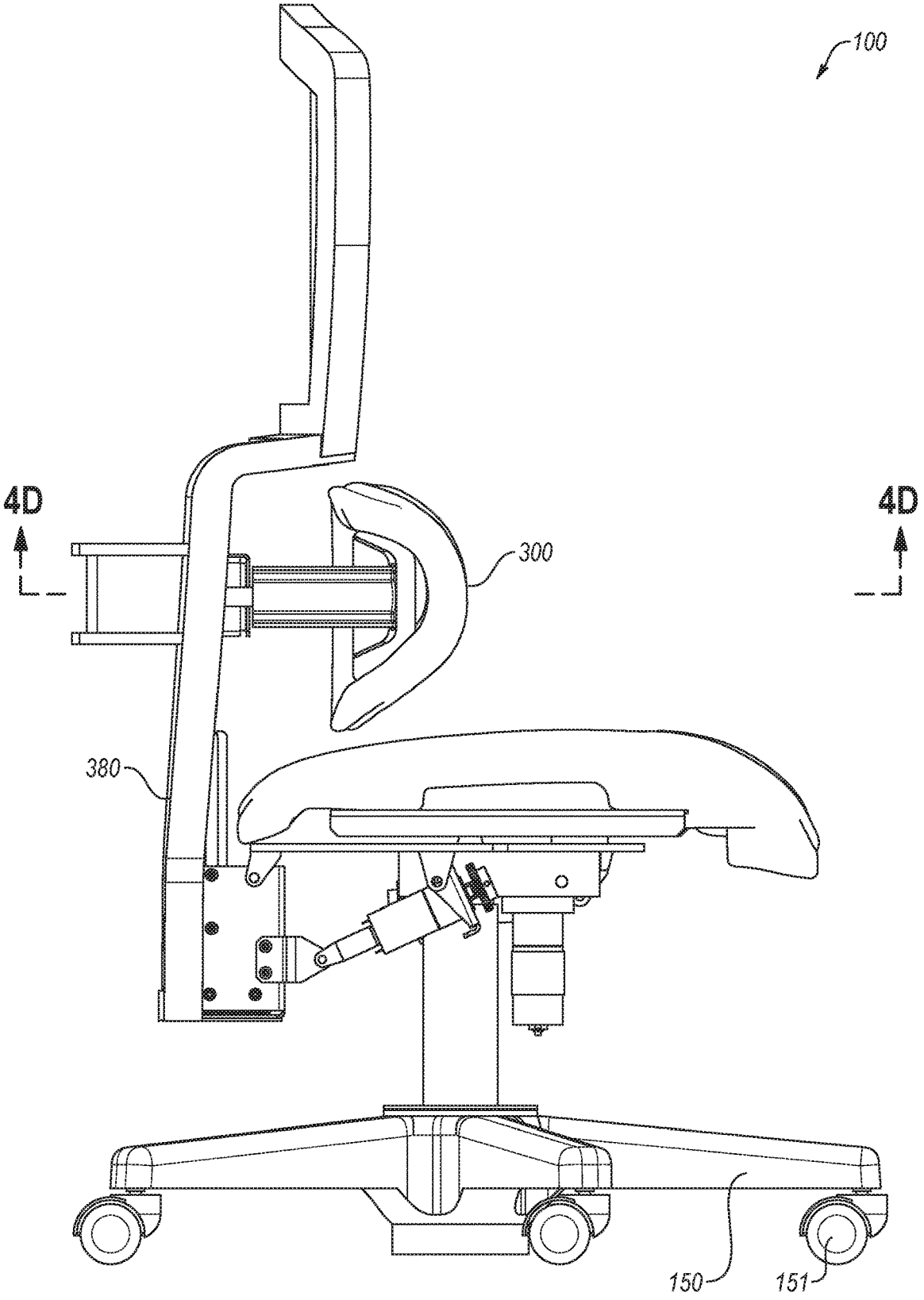
Figure 4D:
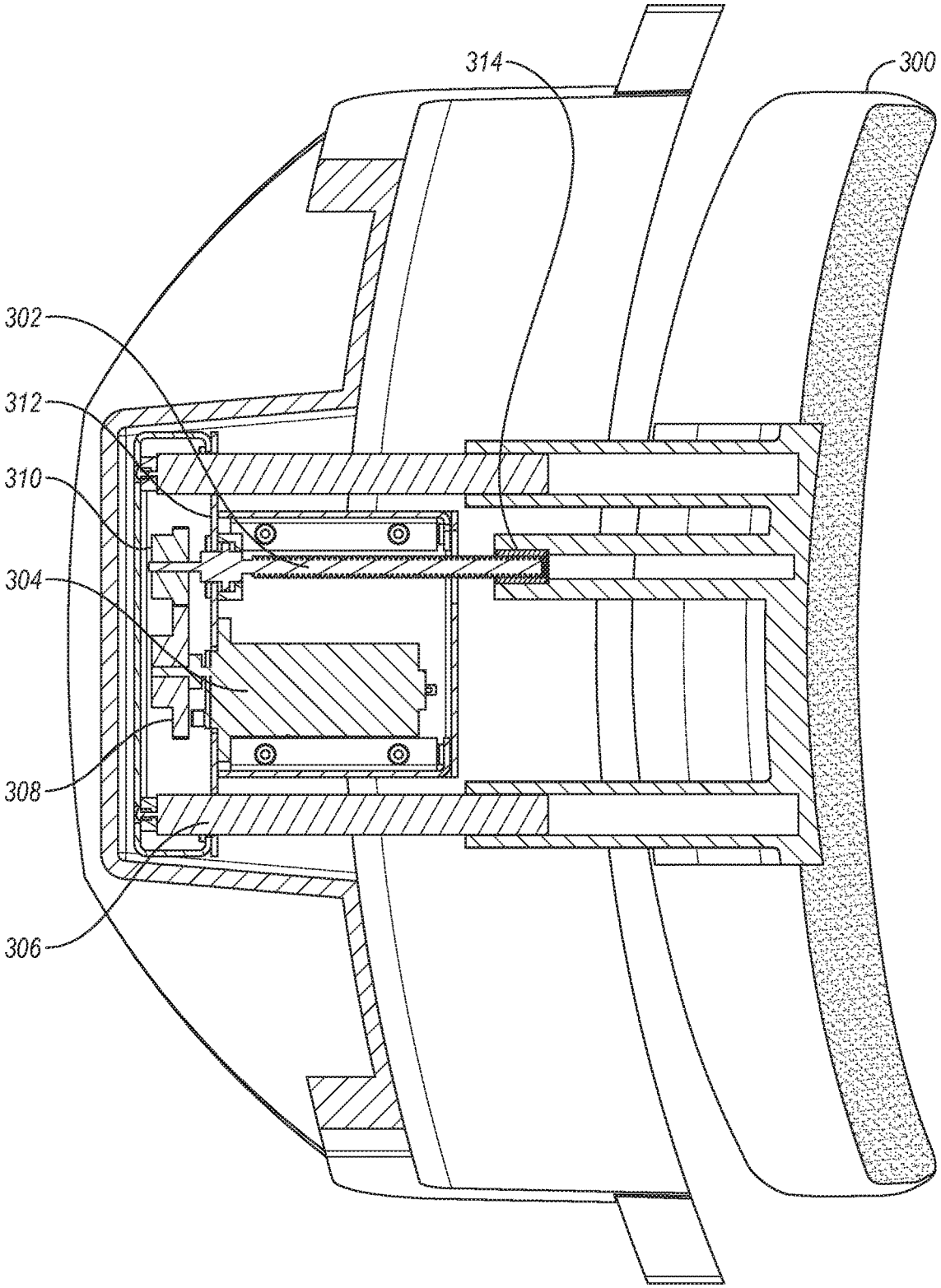
Figure 5A:
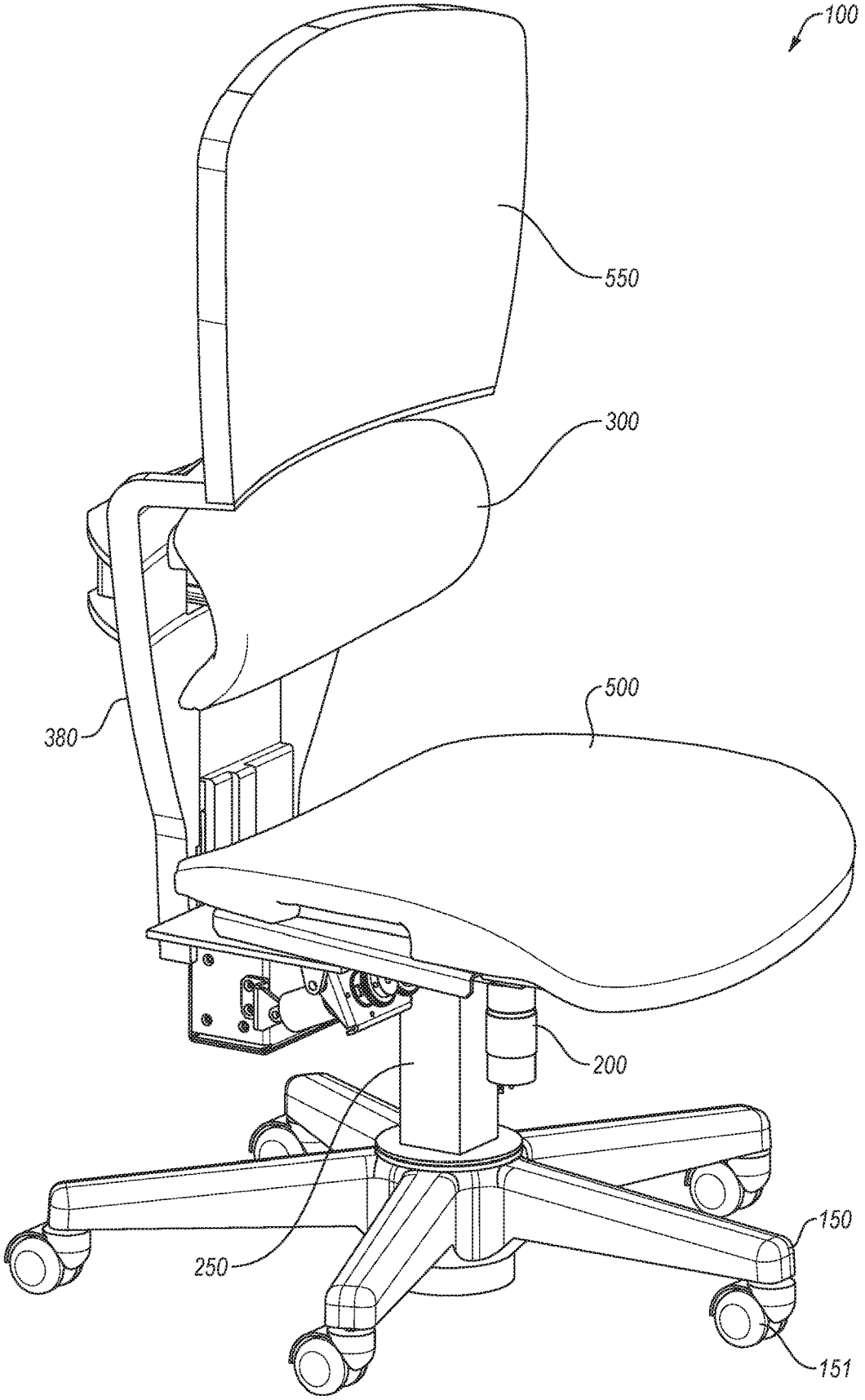
Figure 5B:
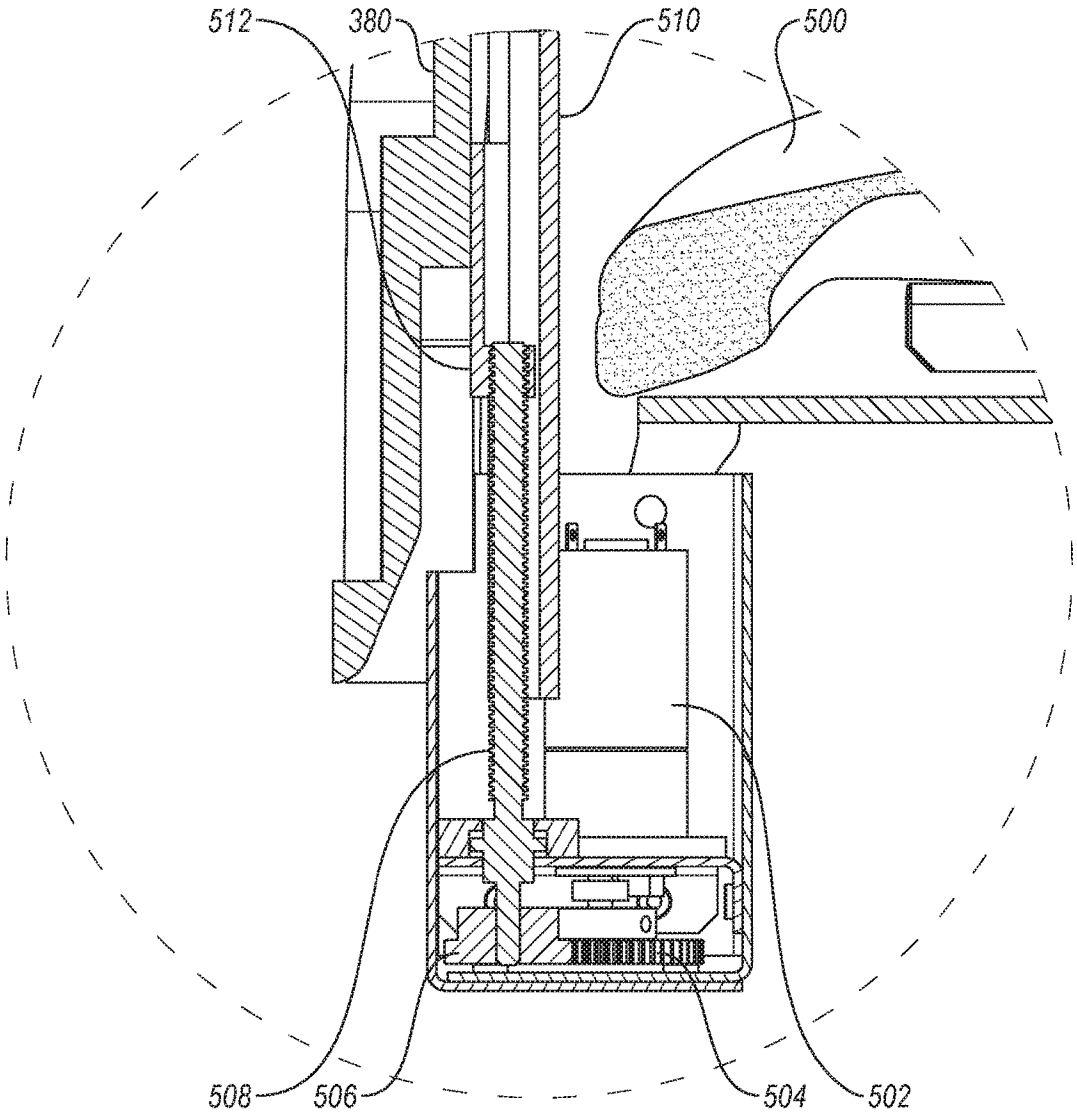
Figure 5C:
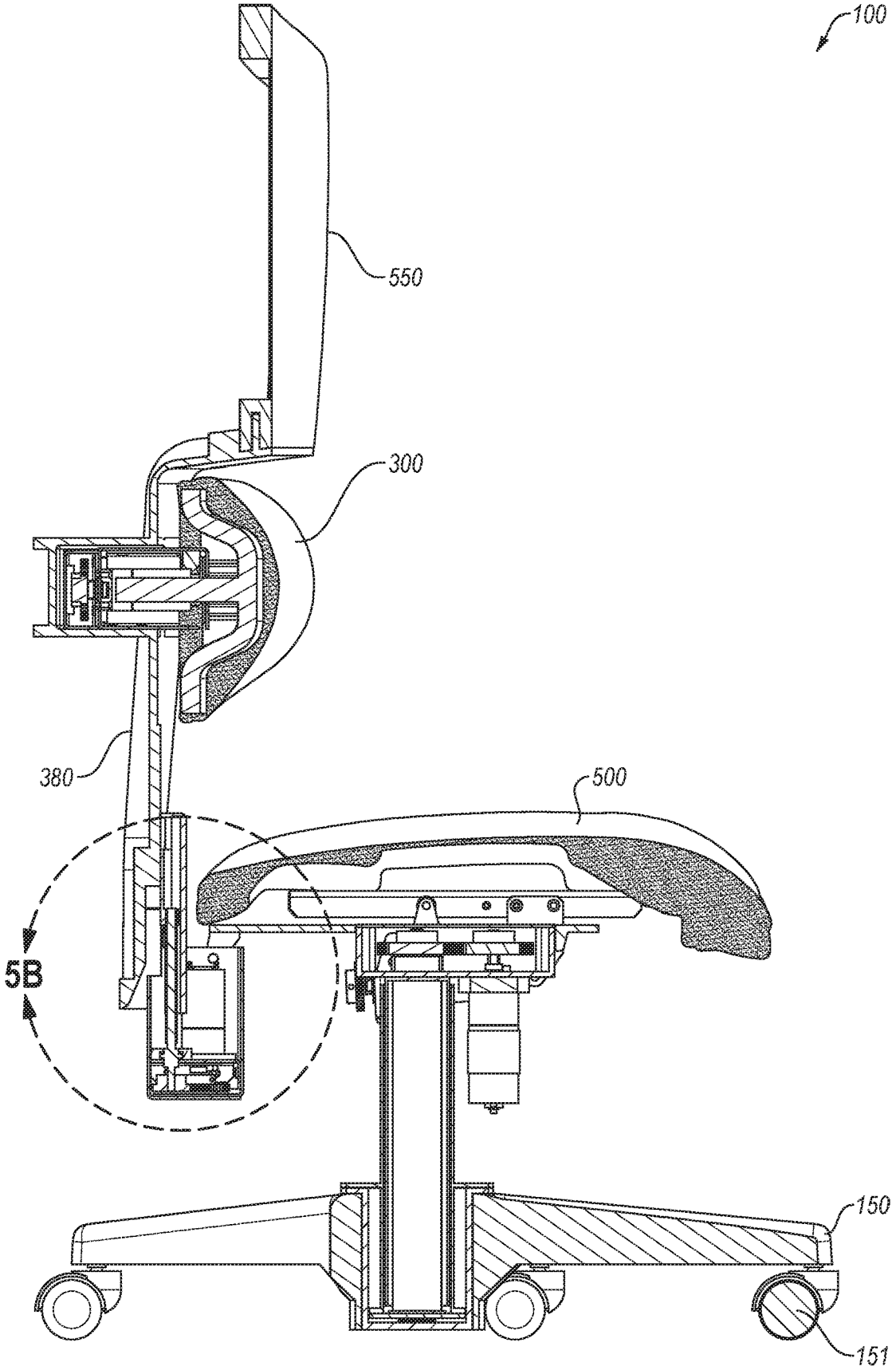
Figure 5D:
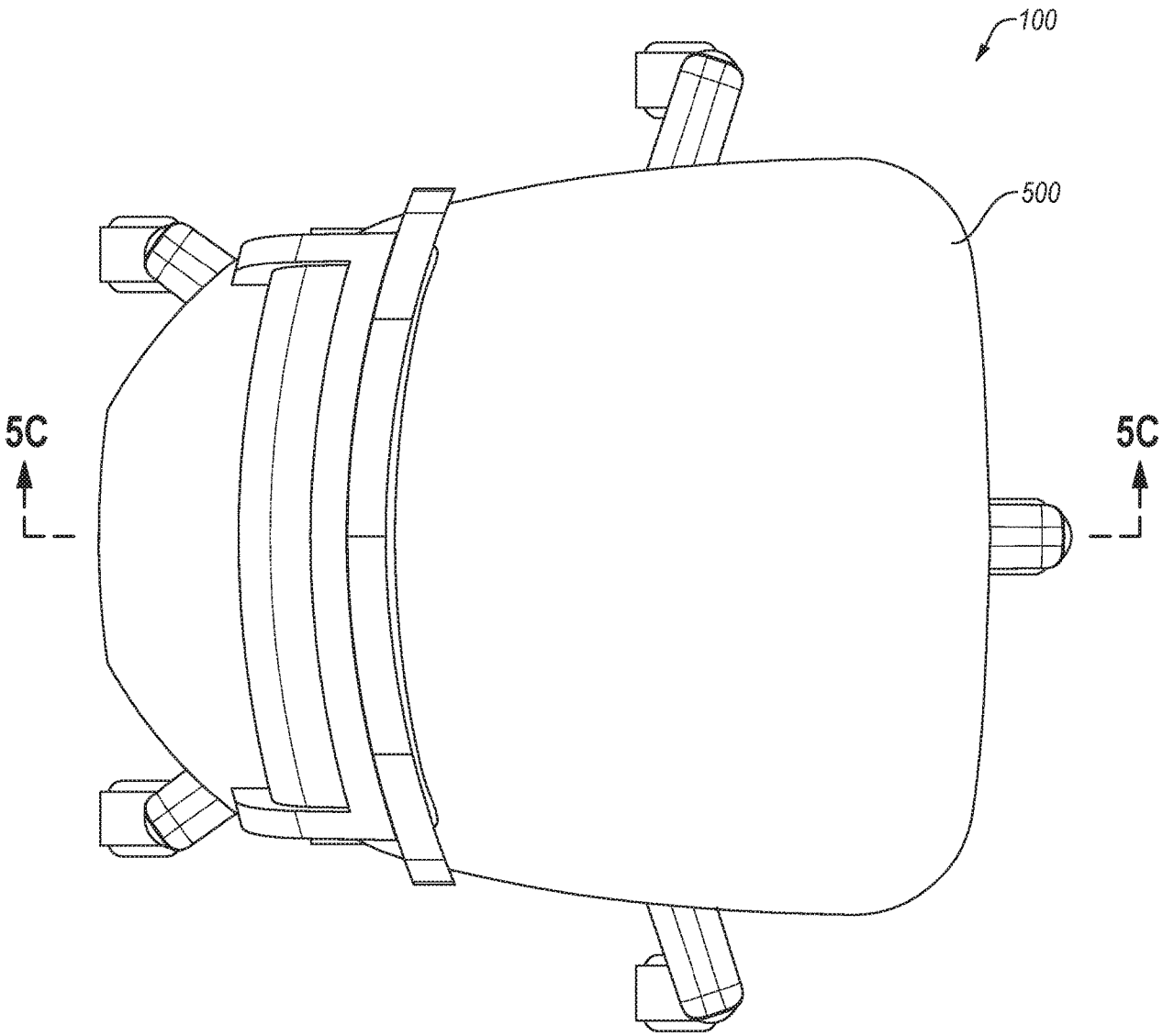

As is clearly shown in FIGS. 3D and 4D, the lumbar adjustment motor 304 rotates a threaded shaft 302. The nut 314 is located in the lumbar portion 300. As the lumbar adjustment motor 304 rotates, the nut 314 moves along the threaded shaft 302 which moves the lumbar portion 300 with respect to the threaded shaft 302. The guide 306 keeps the lumbar portion 300 from rotating and allows the lumbar portion to move from the retracted to extended position.

FIGS. 5A-5D illustrate the ability of the lumbar portion 300 back portion 550 to be adjusted up and down from the cushion surface 500 by raising the back support 550 and lumbar portion 300 up and down with respect to the cushion surface 500 along the back-support plate 380. In the embodiment shown herein, the vertical adjustment of the back support 550 along with the lumbar section 300 is as much as four inches. The movement mechanism for moving the back portion 550 and the lumbar portion 300 works the same way as the mechanism does on the in and out position of the lumbar portion 300. A back support back support motor 502 drives a pair of gears 504 and 506 which in turn drive a threaded shaft 508 and a nut 512 fastened to the back-support plate 380 moves up and down as the threaded shaft 508 is located. A guide 510 on the surfaces of the back-support plate 380 both supports the back from collapsing and prevents it from rotating.

Similar to the features described above with respect to the linear actuator motor 200, as is shown in FIG. 9, both the lumbar adjustment motor 304 and the back support motor 502 may also be connected and controlled by the controller 910, which may in turn be in communication with the application 960 of a user device 970 via the network 980. As such, the user may be able to selectively adjust the lumbar position and the back support/lumbar height by interacting with the GUI 950. More particularly, the user may use the GUI 950 to request adjustments of the lumbar position and back support/lumbar height, which are then communicated to the controller 910 via the network so as to selectively drive the lumbar adjustment motor 304 and the back support motor 502 so as to achieve the desired lumbar position and back support/lumbar height. Further, as was previously described, the user may then save their preferences in a user profile that is then used to automatically return the adjustable chair 100 to their preferred settings at predesignated times and/or each time the user logs into the application 960. Alternatively, in another mode, pre-defined positions recommended by a back health expert or professional may be designated as "best practices" recommendations, which have different settings for different times of the day so as to consistently and correctly move the user to new and proper positions throughout the day. As may be understood, in some instances, this may include a user using the application 960 to "opt-in" or select a "best practices" mode which in turn causes the controller 910 to automatically change the chair position to a variety of recommended positions throughout the day.

Adjustable Angle of Chair Back

Figure 6A:
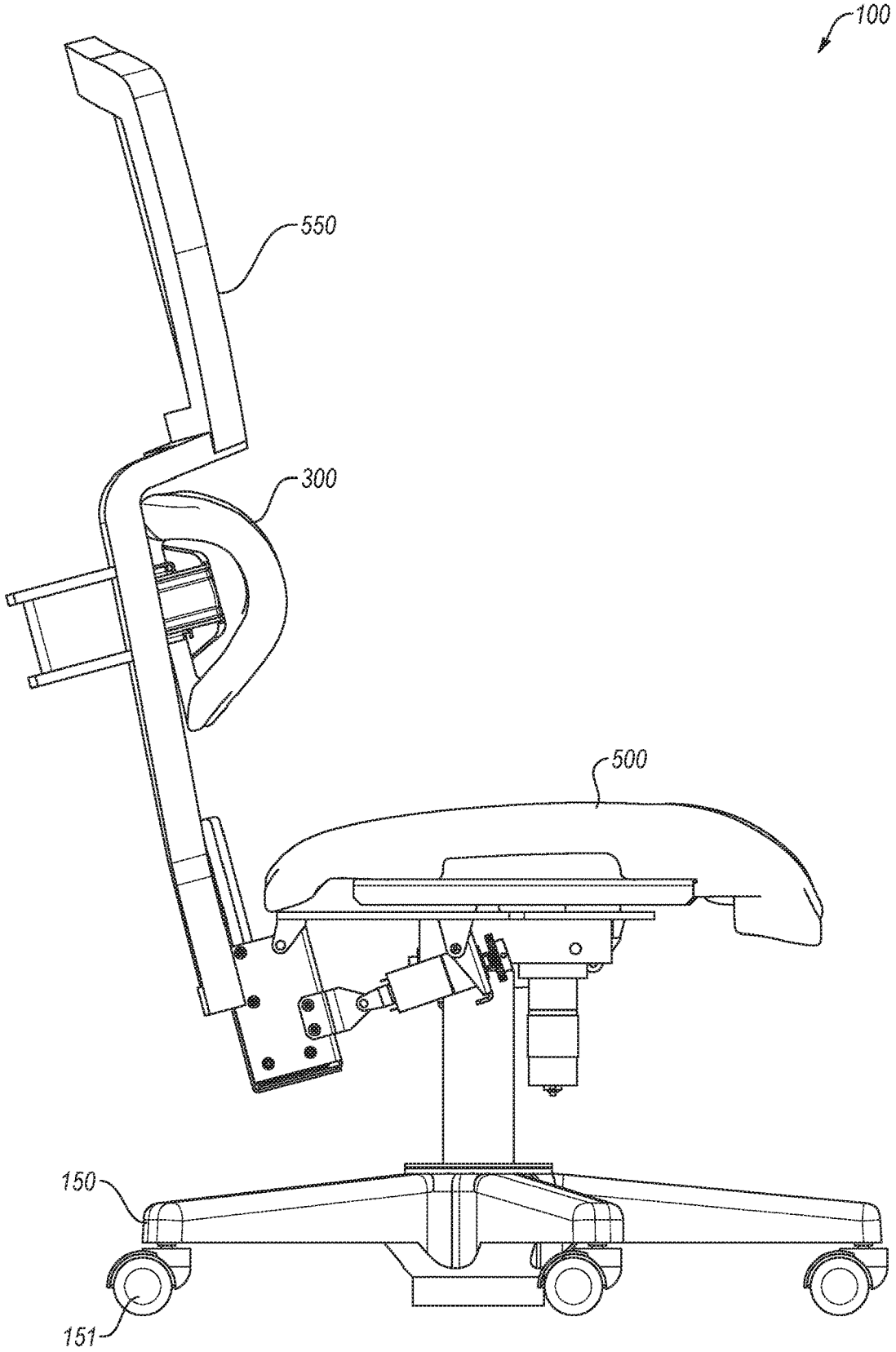
FIGS. 6A-6C illustrate the adjustable chair back angle feature of the adjustable chair according to some aspects of the invention.
Figure 6B:
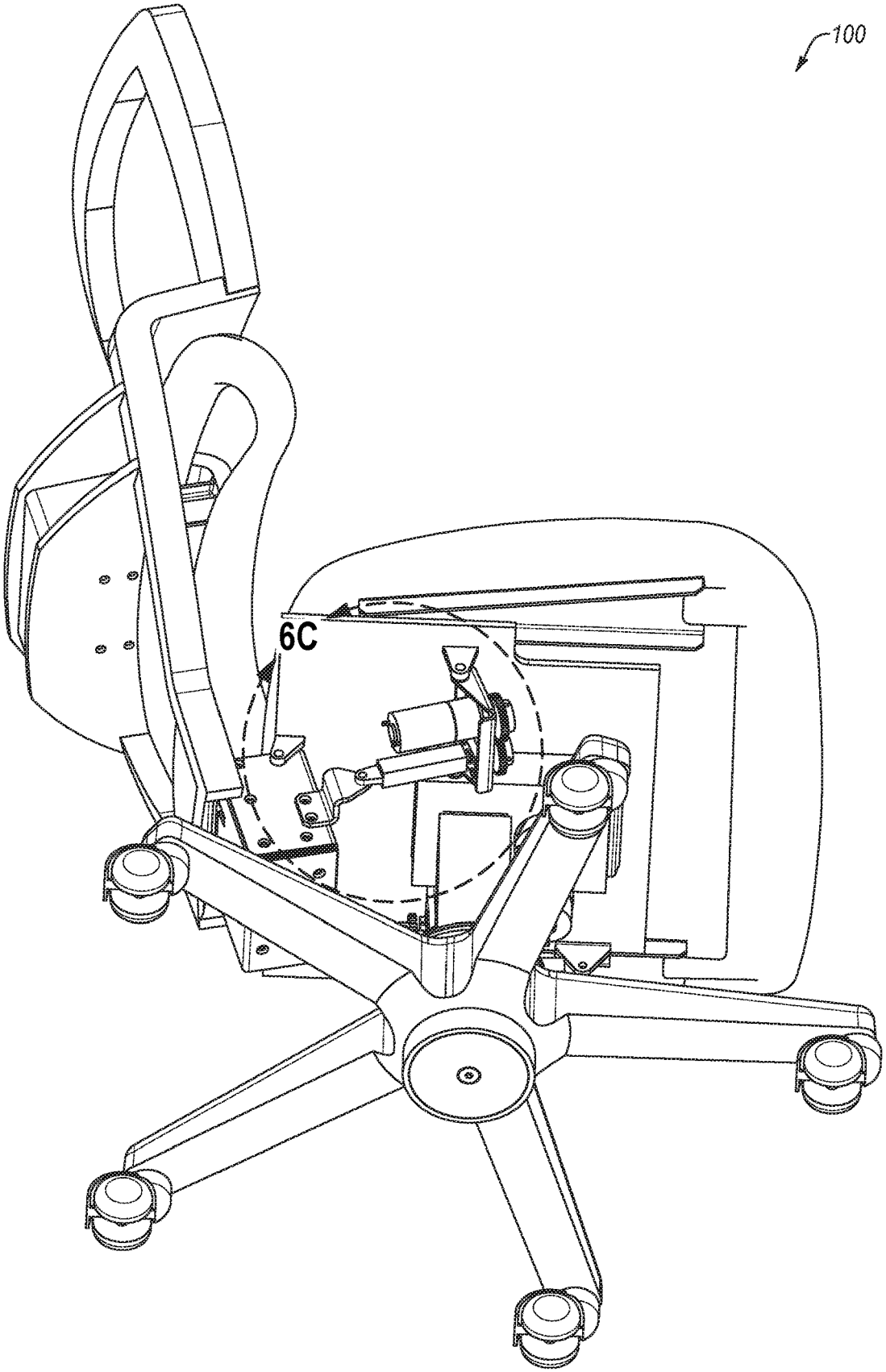
Figure 6C:
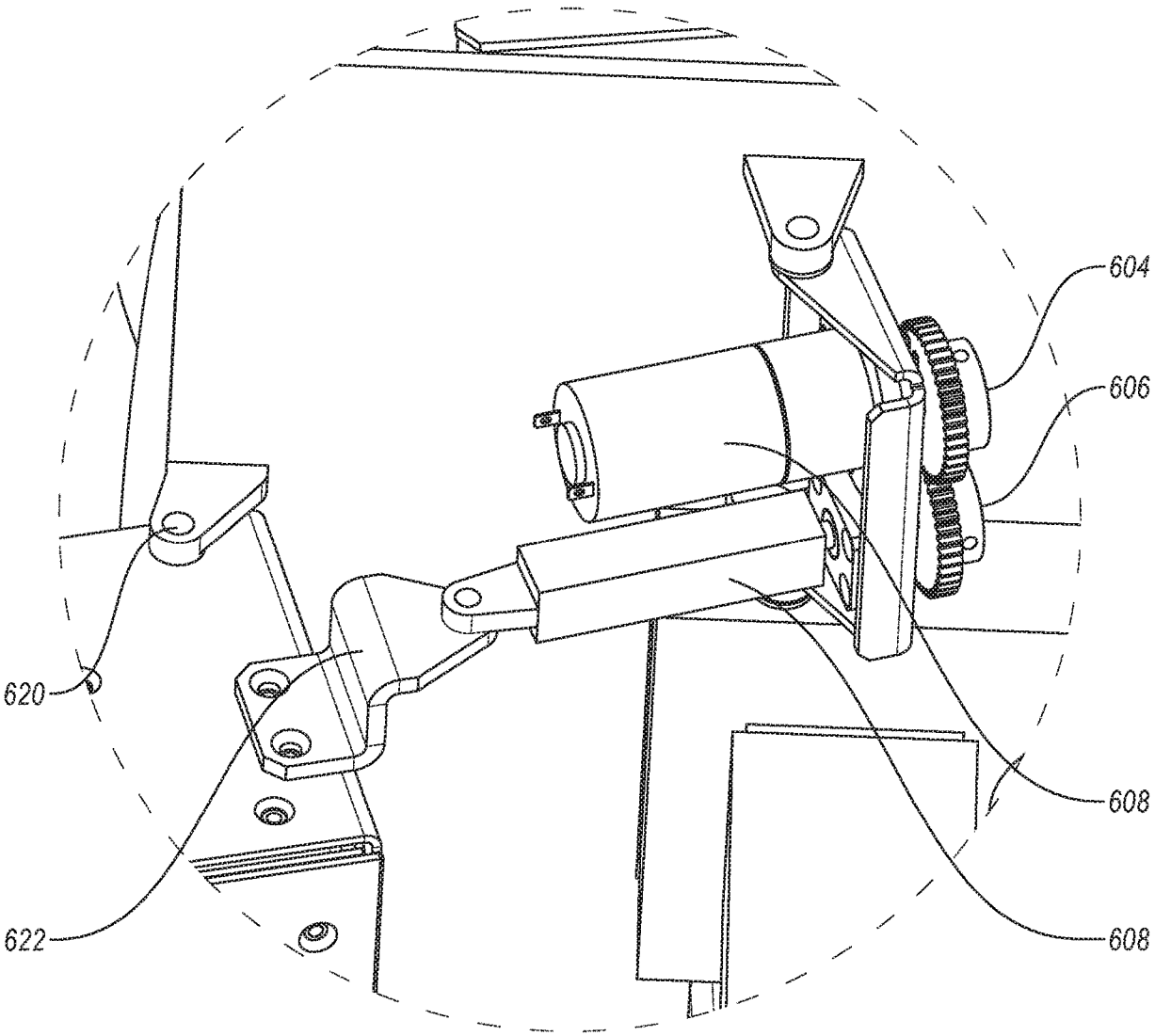

Pages 6A-6C illustrate another adjustable feature of the adjustable chair 100. More specifically, pages 6A-6C illustrate the ability of the back portion 550 to rotate 15 degrees away from the vertical direction with respect to the seat cushion 500. As can be observed in detail in FIG. 6C, the adjustment of the back portion 550 is performed by a back angle motor 602 which drives a driving gear 604, a driven gear 606. The driven gear 606 in turn drives a threaded shaft and nut 608 which are attached at 622 to the back-support plate 380. As the back angle motor 602 is driven, the back portion 500 rotates above the pivot point 620. In one embodiment, the back angle motor 602 can be controlled so that any amount of adjustment can be accommodated from zero to 15 degrees.

Similar to the features described above with respect to the linear actuator motor 200, the lumbar adjustment motor 304, and the back support motor 502, as is shown in FIG. 9, both the back angle motor 602 may also be connected and controlled by the controller 910, which may in turn be in communication with the application 960 of a user device 970 via the network 980. As such, in some instances, the user may be able to selectively adjust the angle of the seat back with respect to the floor by interacting with the GUI 950. More particularly, the user may use the GUI 950 to request adjustment of the angle of the seat back with respect to the floor, which request is then communicated to the controller 910 via the network 980 so as to selectively drive the back angle motor 602 so as to achieve the desired effect. Further, the preferred seat back angle may be saved in the user profile so as to automatically adjust the adjustable chair 100 according to the user's preferences.

In the "best practices" mode, the application 960 may cause the controller 910 to automatically adjust the adjustable chair 100 according to recommended settings which promote posture and back health.

Adjustable Seat Cushion

Figure 7A:
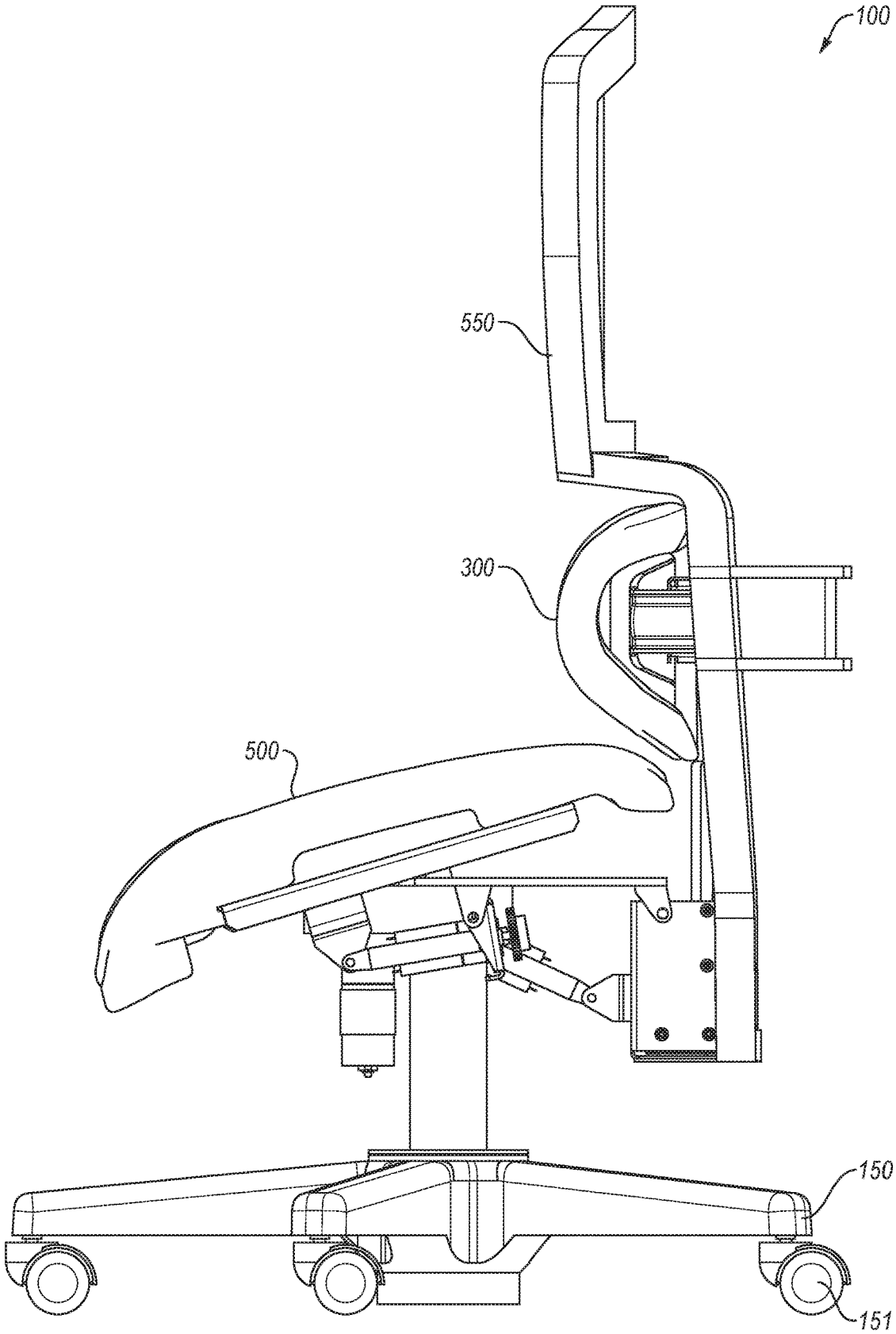
FIGS. 7A-7C illustrate the adjustable seat cushion feature of the adjustable chair according to some aspects of the invention.
Figure 7B:
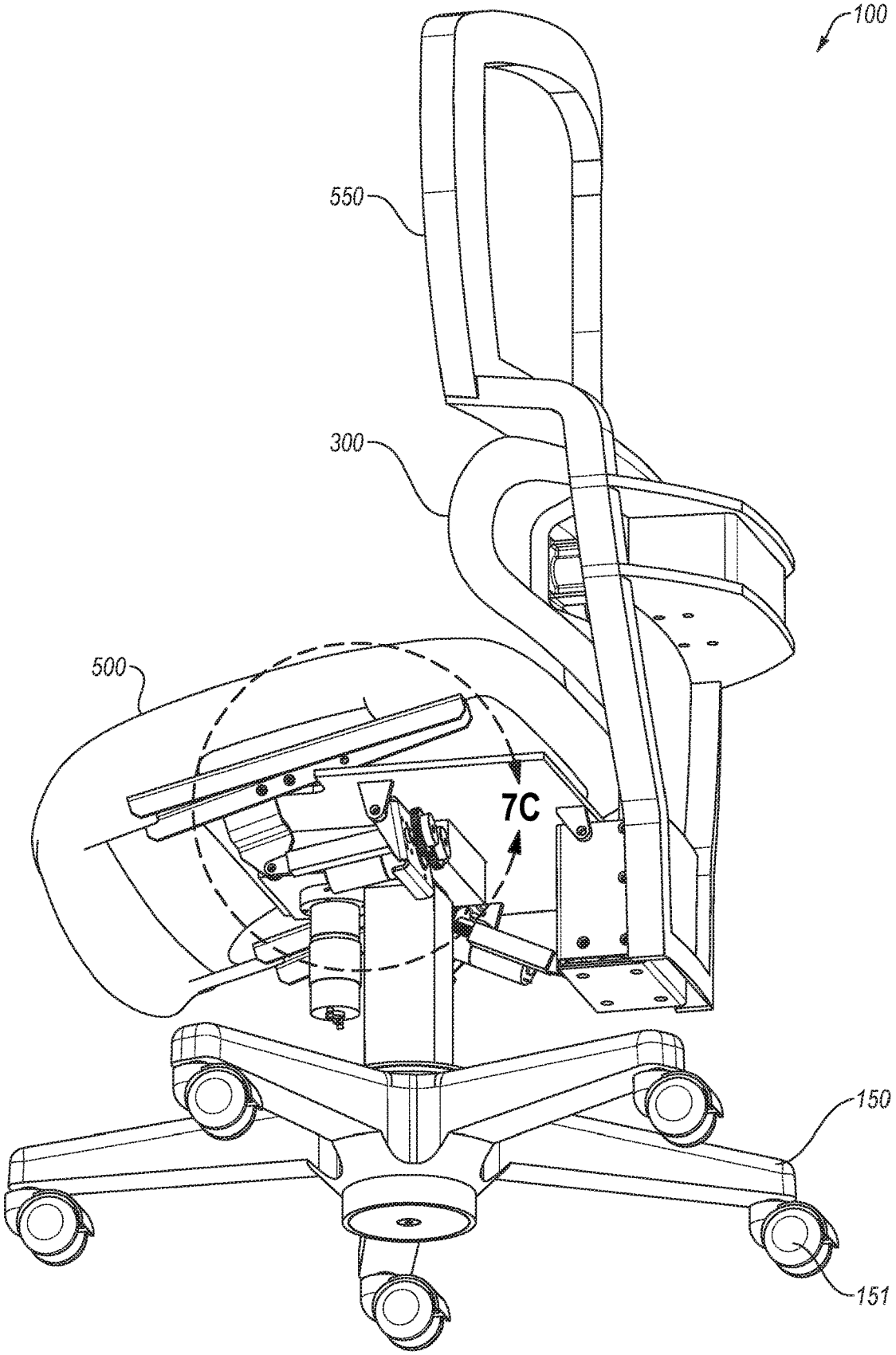
Figure 7C:
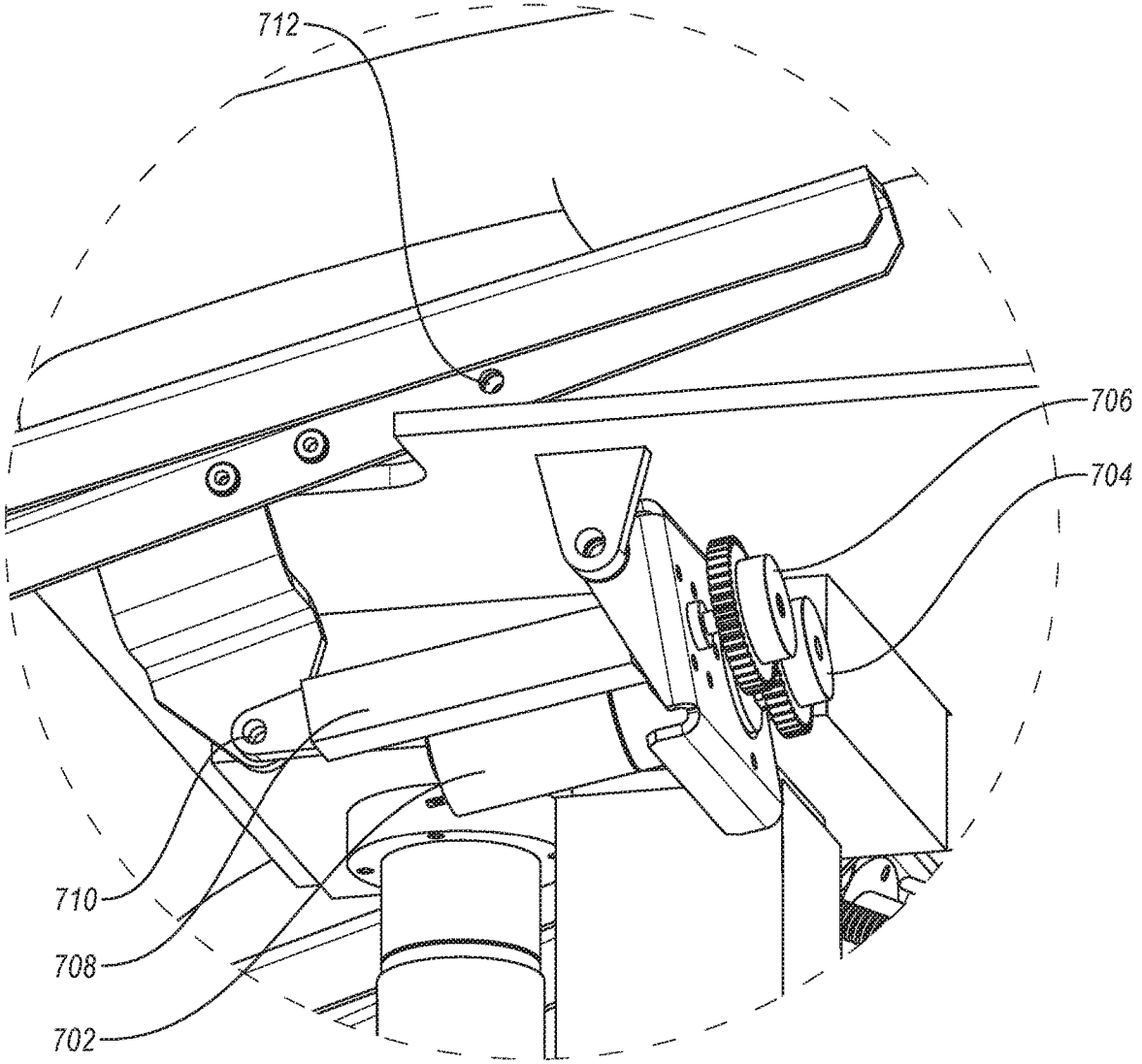

FIGS. 7A-7C illustrate another adjustable aspect of the adjustable chair 100. More specifically, FIGS. 7A-7C illustrate the ability of the seat cushion 500 to be rotated in up or down or to be tilted with respect to a horizontal axis. In the embodiment illustrated in FIGS. 7A-7C, the current design allows for the cushion to be rotated 15 degrees down. As shown in the detail in FIG. 7C, the rotation of the seat cushion is enabled by use of a seat rotation motor 702, connected to a driving gear 704, which in turn drives a driven gear 706, connected to a threaded shaft and nut 708, which are connected to an attach point 710. As the motor 702 is driven the seat cushion 500 rotates around a pivot point 712 to a desired degree of rotation. According to the embodiments described herein, the chair seat is capable of tilting a variety of different directions, including forward.

As is shown in FIG. 9, the seat rotation motor 702 may also be connected and controlled by the controller 910, which may in turn be in communication with the application 960 of a user device 970 via the network 980. As such, the user may be able to selectively adjust the degree of seat rotation by interacting with the GUI 950. More particularly, the user may use the GUI 950 to request an adjustment of the seat rotation, which are then communicated to the controller 910 via the network so as to selectively drive the seat rotation motor 702 so as to achieve the desired seat rotation position. Further, as was previously described, the user may then save their preferences in a user profile that is then used to automatically return the adjustable chair 100 to their preferred settings at predesignated times and/or each time the user logs into the application 960, or in the "best practices" mode, a series of recommended settings established by a medical professional or expert communicated to the application 960 or otherwise established at the application 960 may then be communicated to the controller 910 so as to create a series of recommended settings which promote back health and posture and which are then communicated to the controller 910 to automatically adjust the adjustable chair 100 according to the recommended settings.

Adjustable Footrest

Figure 8A:
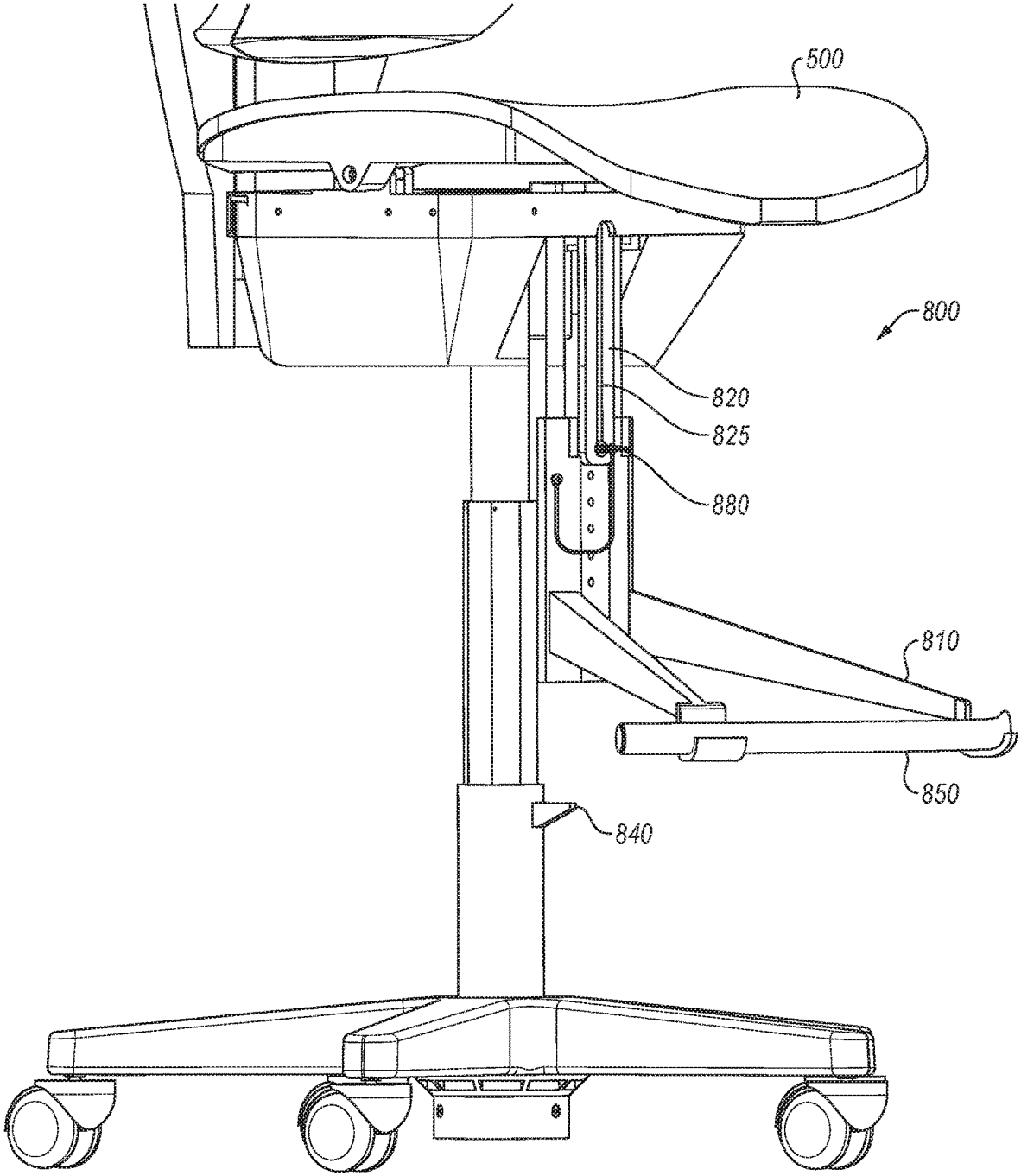
FIGS. 8A-8B illustrate the adjustable footrest feature of the adjustable chair according to some aspects of the invention.
Figure 8B:
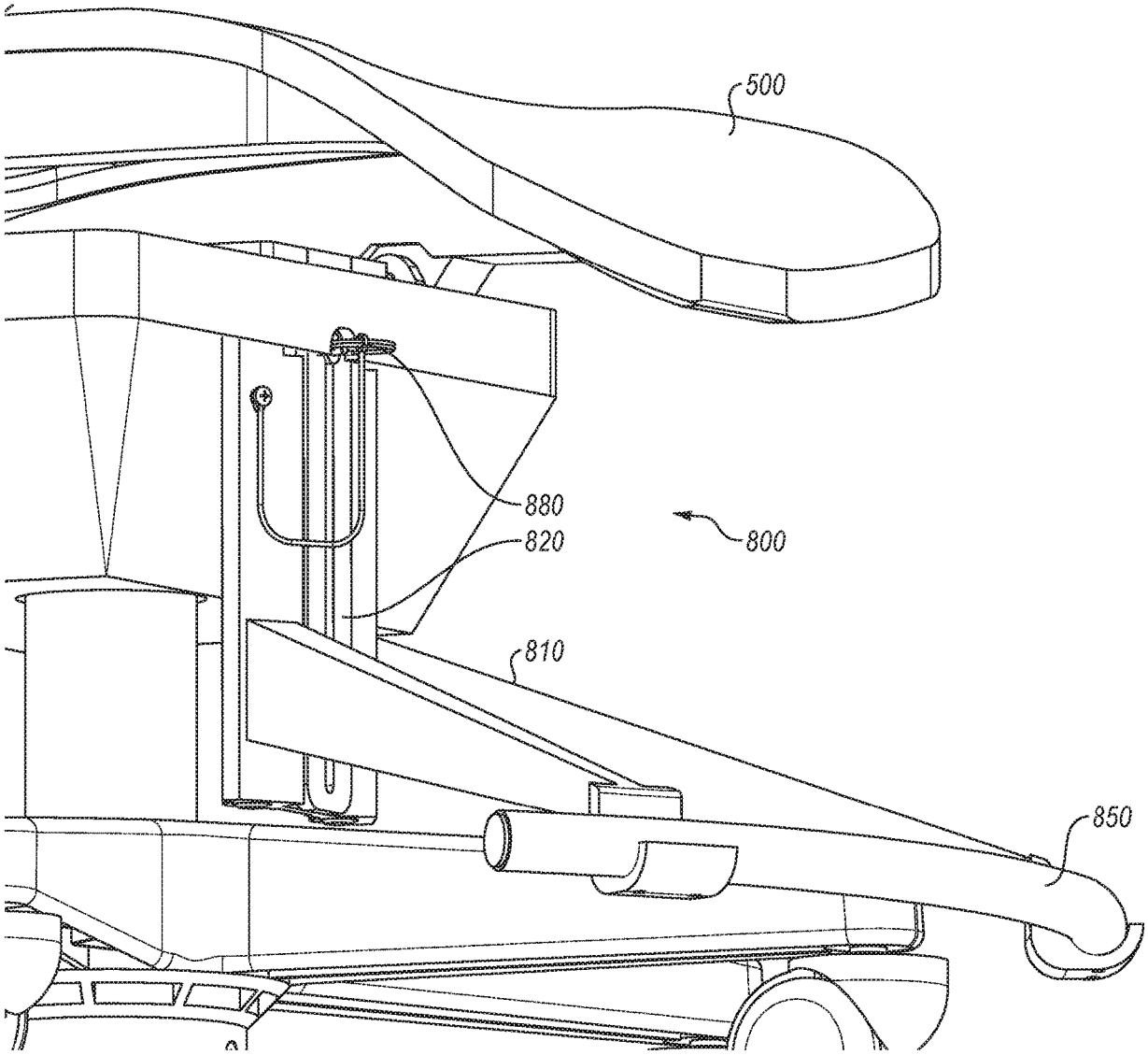

In some configurations, the adjustable chair 100 may also include a footrest. In the embodiments shown in FIGS. 8A-8B, the adjustable chair 100 includes an adjustable footrest 800. In the embodiment shown in FIGS. 8A-8B, the adjustable footrest 800 includes a stationary part 820 which is attached to a housing that supports the seat cushion 500. As the seat cushion 500 is moved up and down along with the movement of the linear actuator 250, the stationary part 820 moves with and in association with the seat cushion 500. In some instances, this may include a range of up to 20 inches. In addition to the stationary part 820, the adjustable footrest 800 includes a sliding assembly 810 which is capable of sliding with respect to the stationary part 820. A pin 880 may be used to extend through a portion of the sliding assembly 810 to extend through a slot 825 in the stationary part 820 so as to fix the sliding assembly 810 to the stationary part 820. The pin 880 may be positioned in a plurality of holes in the sliding assembly 810 to establish a distance between a footrest portion 850 with respect to the seat cushion 500. In instances where a user does not want to use a footrest 800, the pin 880 may be removed so as to enable the sliding assembly 810 to be removed with respect to the stationary part 820.

To prevent the footrest 800 assembly from hitting the floor during adjustment, a tab 840 may be included on the linear actuator 250 so as to come into contact with a corresponding structure on the sliding assembly. In some instances, the corresponding structure of the sliding assembly may comprise a tab, protrusion, or any number of configurations.

Programmable Motor Control

Another adjustable aspect of some embodiments described herein is the ability of all of the motor controls 200, 304, 502, 602, and 702 to be controlled by a programmable interface, such as a graphic user interface 850 operating on a user device 970 such that a user is able to provide enhanced control and feedback which allows the exact position for the amount of adjustment. In one embodiment, the motor controls 200, 304, 502, 602, and 702 are also designed to be adjusted or controlled via a cell phone and may be associated with a program, such as an application 960, that allows a user to create a profile that may be stored in a memory 962. For one example, a user may store a personal profile which causes the adjustable chair 100 to be adjusted to a preferred or preset position or configuration profile corresponding to a preferred chair position or configuration at various times of the day or to be automatically adjusted according to a daily or other time-based parameter. This feature allows the chair to have preset conditions for individual users.

In another configuration, the adjustable chair 100 is capable of having a program which stores the positions in conjunction with a movable desk height. Additionally, in order to promote proper back health, the adjustable chair 100 is capable of moving according to a predefined "Best Practice" preset according to a configuration as best determined by experts or other specialists who are commissioned to design a seat configuration which would most advantage the user. As such, a user may use the application 960 to select a "Best Practice" preset, the preset comprising a single or series of seating positions established by a medical or other professional which promote back health and proper posture. In some instances, the "Best Practice" preset may have different positions at different times of the day or for different durations of time. Consequently, by selecting the "Best Practice" setting, the adjustable chair 100 may then automatically be adjusted throughout the users day or over use without requiring any additional action by the user.

This feature also allows a program to be written which can automatically vary the positions of the chair at different time intervals. The different positions provide relief and rest for a person's back during the day. Thus, eliminating pain and stiffness from sitting in a chair for long periods of time. As may be understood, by combining all of the motor driven controls along with the ability to program movements at different times during the day is not presently available in adjustable chairs which are currently known in the art.

In some configurations, the user may create, monitor, or modify the user profile which controls the memory where the adjustable chair 100 configurations are stored via a variety of computer program applications, including an application which may be installed and controlled on and via the user device, such as a cellular phone or other portable computing device. In some configurations, this may also allow the creation of multiple user profiles which can be pre-set or saved, for example, so two different persons using the chair can instantly command adjustment to their preset settings. As such, the chair may adjust the position by a user interacting with the adjustable chair 100 via a cellular phone to indicate that they will be using the adjustable chair 100 instead of another user.

In some configurations, the controller 810 may also comprise a series of switches or other manual controls which may be used by the user to manually adjust the chair. In some instances, these switches may be disposed on the adjustable chair 100. As may be understood, the switches of the controller 810 in this configuration may be able to manually control some or all the motors 200, 304, 502, 602, and 702. This manual control may be used in association with or in place of the remote control configuration described above.

As used in the present disclosure, the terms "module" or "component" may refer to specific hardware implementations configured to perform the actions of the module or component and/or software objects or software routines that may be stored on and/or executed by general purpose hardware (e.g., computer-readable media, processing devices, etc.) of the computing system. In some embodiments, the different components, modules, engines, and services described in the present disclosure may be implemented as objects or processes that execute on the computing system (e.g., as separate threads). While some of the system and methods described in the present disclosure are generally described as being implemented in software (stored on and/or executed by general purpose hardware), specific hardware implementations or a combination of software and specific hardware implementations are also possible and contemplated. In the present disclosure, a "computing entity" may be any computing system as previously defined in the present disclosure, or any module or combination of modulates running on a computing system.

Terms used in the present disclosure and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

All examples and conditional language recited in the present disclosure are intended for pedagogical objects to aid the reader in understanding the invention and the concepts contributed by the inventor to furthering the art, and are to be construed as being without limitation to such specifically recited examples and conditions. Although embodiments of the present disclosure have been described in detail, various changes, substitutions, and alterations could be made hereto without departing from the spirit and scope of the present disclosure.

What is claimed is:

1. An adjustable chair comprising:

a seat part;

a seat back disposed along one side of the seat part, the seat back being configured for supporting at least a person's back or shoulders;

a chair base configured for being placed on a floor; and at least one adjustable chair feature including a motor capable of being selectively controlled and driven so as to adjust at least one of:

a rotation or tilt of the seat part, a vertical distance between the seat back and the one side of the seat part, an angle position between the seat back and the seat part, and a distance between the chair base and the seat part, a lumbar support providing incremental and progressive resistance to support the person's lower back, the lumbar support being adjustable so as to incrementally protrude a distance from the seat back towards the person's back or shoulders as a lumbar support motor is driven, wherein the lumbar support is further adjustable and is configured to move in a vertical direction with respect to the seat part.

2. The adjustable chair of claim 1, wherein the at least one adjustable chair feature comprises a linear actuator connected at one end to the chair base and to the seat part, the linear actuator comprising an inner locking guide, a middle locking guide, and an outer locking guide, wherein the linear actuator moves between an expanded and collapsed state as the motor is driven so as to increase and decrease the distance between the seat part and the chair base, and wherein the inner locking guide, middle locking guide, and outer locking guide are configured so as to prevent rotation with respect to each other as the motor is driven.

3. The adjustable chair of claim 1, wherein the at least one adjustable chair feature comprises a seat back adjustment means which, when the motor is driven causes the seat back to rotate with respect to the seat part so as to form an acute or obtuse angle with respect to the seat part.

4. The adjustable chair of claim 1, wherein the at least one adjustable chair feature comprises a seat rotation means, which, when the motor is driven causes the seat part to rotate with respect to a horizontal axis.

5. The adjustable chair of claim 1, wherein the at least one adjustable chair feature is further capable of being controlled via a mechanical adjustment.

6. The adjustable chair of claim 5, wherein the mechanical adjustment includes a plurality of mechanical of switches disposed on the adjustable chair.

7. The adjustable chair of claim 1, wherein the motor is controlled and caused to be driven via a controller capable of communicating with an electronic device of a user via a network connection, the controller causing the motor to be driven so as to adjust at the least one of:

the rotation or tilt of the seat part, the vertical distance between the seat back and the one side of the seat part, the angle position between the seat back and the seat part, and the distance between the chair base and the seat part according to a chair setting profile set by the electronic device.

8. The adjustable chair of claim 7, wherein the electronic device is a smart phone capable of communicating with the controller via a network connection.

9. The adjustable chair of claim 7, wherein the electronic device of the user includes a memory which stores the chair setting profile comprising a series of recommended preset seat adjustment settings, and wherein the controller is capable of driving the motor so as to adjust the at least one of the rotation or tilt of the seat part, the position of the seat back, the angle position between the seat back and the seat part, and the distance between the chair base and the seat part according to the chair setting profile according to the recommended preset adjustment settings.

10. The adjustable chair of claim 9, wherein the recommended preset adjustment settings comprise different settings for different durations or different times of a day.

11. The adjustable chair of claim 1, further comprising an adjustable footrest capable of adjusting the distance between the seat part and a footrest configured for supporting the person's feet.

* * * * *